US011006705B2

(12) United States Patent
Hatanaka et al.

(10) Patent No.: US 11,006,705 B2
(45) Date of Patent: May 18, 2021

(54) CLASP MECHANISM FOR WRIST-WORN DEVICES

(71) Applicant: Apple Inc., Cupertino, CA (US)

(72) Inventors: Motohide Hatanaka, Menlo Park, CA (US); Hsiang Hung Chen, New Taipei (TW); Erik L. Wang, Redwood City, CA (US); Michael J. Webb, Scotts Valley, CA (US); Douglas J. Weber, San Francisco, CA (US); Daniele De Luliis, San Francisco, CA (US); Kah Sim Quah, Penang (MY)

(73) Assignee: Apple Inc., Cupertino, CA (US)

( * ) Notice: Subject to any disclaimer, the term of this patent is extended or adjusted under 35 U.S.C. 154(b) by 251 days.

(21) Appl. No.: 15/937,714

(22) Filed: Mar. 27, 2018

(65) Prior Publication Data

US 2018/0213896 A1 Aug. 2, 2018

Related U.S. Application Data

(63) Continuation of application No. 15/012,831, filed on Feb. 1, 2016, now Pat. No. 9,949,537.
(Continued)

(51) Int. Cl.
*A44C 5/24* (2006.01)

(52) U.S. Cl.
CPC ..... *A44C 5/243* (2013.01); *A44D 2203/00* (2013.01)

(58) Field of Classification Search
CPC ..... A44C 5/243; A44C 5/24
See application file for complete search history.

(56) References Cited

U.S. PATENT DOCUMENTS 1,746,457 A * 2/1930 Bigney ..... A44C 5/243 24/71 J
2,126,263 A 8/1938 Kestenman
(Continued)

FOREIGN PATENT DOCUMENTS

CN 2052214 U 2/1990
CN 1147358 A 4/1997
(Continued)

OTHER PUBLICATIONS

Author Unknown, "Ikepod Wristwatches by Mark Newson," http://www.dezeen.com/2007/12/10/ikepod-wristwatches-by-marc-newson/, 32 pages, Dec. 10, 2007.
(Continued)

*Primary Examiner* — Jason W San
(74) *Attorney, Agent, or Firm* — Morgan, Lewis & Bockius LLP

(57) ABSTRACT

Clasp assemblies for bands (e.g., for watches) are disclosed. In some embodiments, a clasp assembly may include a plurality of pivotally interconnected links, where respective links are releasably coupled to one another, and spring assemblies disposed between respective links impart biasing forces between the respective links. In some embodiments, a clasp assembly may include a clasp body, a clasp cover, and a connecting arm pivotally coupled to the clasp body at a first end of the connecting arm, and pivotally coupled to the clasp cover at a second end of the connecting arm. The clasp assembly may include springs, magnets, elastomer members, and/or other mechanisms, components, or assemblies that impart a biasing force between the clasp body, the connecting arm, and/or the clasp cover.

16 Claims, 30 Drawing Sheets

Related U.S. Application Data

(60) Provisional application No. 62/129,659, filed on Mar. 6, 2015.

(56) References Cited

U.S. PATENT DOCUMENTS 2,346,887 A 4/1944 Winkler
2,408,279 A 9/1946 Valcourt
2,505,044 A 4/1950 Heinrich
2,518,551 A 8/1950 Jaccarino
3,293,714 A 12/1966 Shafer
3,376,616 A 4/1968 Kaczorowski
3,550,216 A * 12/1970 Gandleman ..... A44C 5/243 24/71 J
3,589,341 A 6/1971 Krebs
3,675,284 A 7/1972 Rieth
3,747,171 A 7/1973 Montague, Jr.
4,178,751 A 12/1979 Liautaud
4,217,681 A * 8/1980 Grohoski ..... A44C 5/14 224/164
4,249,267 A 2/1981 Voss
4,266,326 A * 5/1981 Hong ..... A44C 5/14 224/177
4,414,714 A 11/1983 Kostanecki et al.
4,414,719 A * 11/1983 Capolupo ..... A44C 5/14 224/164
4,447,238 A 5/1984 Eldridge, Jr.
4,605,312 A * 8/1986 Sellier ..... G04B 37/1486 224/177
4,615,185 A 10/1986 Bollinger
4,941,236 A 7/1990 Sherman et al.
5,130,899 A 7/1992 Larkin et al.
5,146,437 A 9/1992 Boucheron
5,244,134 A 9/1993 Riley
5,305,503 A 4/1994 Yamagata
5,307,582 A 5/1994 Quintel
5,668,784 A 9/1997 Iguchi
5,914,913 A 6/1999 Shriqui
6,067,692 A 5/2000 Chang
6,073,316 A * 6/2000 Ferrario ..... A44C 5/24 24/71 J
6,094,782 A 8/2000 Gay et al.
6,163,938 A 12/2000 Weber-Unger
6,170,131 B1 1/2001 Shin
6,179,025 B1 1/2001 Sutton
6,292,985 B1 9/2001 Grunberger
6,311,373 B1 11/2001 Hashimoto
6,505,385 B2 1/2003 Grunberger
6,588,069 B2 7/2003 Deriaz et al.
6,598,271 B2 7/2003 Nire
6,606,767 B2 8/2003 Wong
6,647,597 B2 11/2003 Reiter
6,678,898 B2 1/2004 Jones et al.
6,701,580 B1 3/2004 Bandyopadhyay
6,726,070 B2 4/2004 Lautner
6,746,058 B2 6/2004 Kienzler
7,243,824 B2 7/2007 Tabata
7,363,687 B2 4/2008 Kraus et al.
7,373,696 B2 5/2008 Schoening et al.
7,640,632 B2 1/2010 Lazarus
7,661,177 B2 * 2/2010 Bloomfield ..... A41F 9/025 2/235
7,806,309 B2 10/2010 Korchmar
7,905,039 B2 3/2011 Karovic
8,091,261 B2 1/2012 Chadwick
8,261,416 B2 9/2012 Rothbaum et al.
8,316,515 B2 11/2012 Slank
8,471,658 B2 6/2013 Fullerton et al.
8,486,481 B2 7/2013 Giuseppin et al.
8,573,458 B1 11/2013 Hamilton
8,578,569 B1 11/2013 Karnoski et al.
8,615,849 B2 12/2013 Rothbaum et al.
8,787,006 B2 7/2014 Golko et al.
8,789,245 B2 * 7/2014 Leger ..... A44C 5/246 24/265 WS
8,789,246 B2 7/2014 Yliluoma et al.
8,967,437 B2 3/2015 Wilson
9,003,611 B2 * 4/2015 Catanese ..... A44C 5/24 24/71 J
9,049,894 B2 6/2015 Wong
9,245,678 B2 1/2016 Fiedler
9,392,829 B2 7/2016 Manuello
9,615,634 B2 * 4/2017 Kaltenrieder ..... A44C 5/246
2005/0102802 A1 5/2005 Sitbon et al.
2005/0265132 A1 12/2005 Ho
2006/0156520 A1 7/2006 Meranto
2006/0186150 A1 8/2006 Willows et al.
2006/0254105 A1 11/2006 Chang
2007/0028429 A1 2/2007 Ishida
2009/0133438 A1 5/2009 Stampfli et al.
2009/0265832 A1 10/2009 Clement
2010/0200627 A1 8/2010 Shen
2010/0258601 A1 10/2010 Thrope
2011/0083254 A1 4/2011 Trutna et al.
2011/0309121 A1 12/2011 Dooley et al.
2012/0216374 A1 8/2012 Manuello
2012/0297592 A1 * 11/2012 Schenk ..... A44C 5/246 24/71 R
2013/0086774 A1 4/2013 Krasinski et al.
2013/0205476 A1 8/2013 Gentile et al.
2013/0326790 A1 12/2013 Cauwels et al.
2014/0083133 A1 3/2014 Lee et al.
2015/0052709 A1 * 2/2015 Sumroy ..... A44B 11/00 24/303
2016/0003269 A1 1/2016 Russell-Clarke et al.
2016/0010673 A1 1/2016 Russell-Clarke et al.
2016/0025119 A1 1/2016 Russell-Clarke et al.
2016/0037878 A1 2/2016 Yabe et al.
2016/0069371 A1 3/2016 Chen et al.
2016/0081440 A1 * 3/2016 Baek ..... G06F 1/163 24/71 J
2016/0157562 A1 * 6/2016 Yang ..... A44B 11/12 24/191
2016/0236592 A1 * 8/2016 Peniche ..... F16B 2/22
2016/0255924 A1 * 9/2016 Hatanaka ..... A44C 5/243
2016/0309859 A1 * 10/2016 Catanese ..... A44C 5/246
2017/0006975 A1 * 1/2017 Sachee ..... A44B 18/0069
2017/0013921 A1 * 1/2017 Frei ..... A44C 5/14
2017/0215531 A1 * 8/2017 Wong ..... A44C 5/22
2018/0110632 A1 * 4/2018 Errico ..... A61F 2/64

FOREIGN PATENT DOCUMENTS

CN 2575724 Y 9/2003
CN 200983868 Y 12/2007
CN 201709560 U 1/2011
CN 102202533 A 9/2011
CN 202026953 U 11/2011
CN 202587325 U 12/2012
CN 202664274 U 1/2013
CN 202704189 U 1/2013
CN 103488076 A 1/2014
EP 2098131 A2 9/2009
FR 1291875 A 4/1962
FR 2492238 A1 4/1982
FR 2532239 A1 3/1984
GB 464417 A 4/1937
GB 1491532 A 11/1977
GB 2113975 A 8/1983
GB 2355281 A 4/2001
WO WO-2010/036090 A2 4/2010
WO WO-2011/0048344 A1 4/2011
WO WO-2012/160195 A2 11/2012

OTHER PUBLICATIONS

Author Unknown, "Tajan," http://www.tajan.com/pdf/7812.pdf, 2 pages, Dec. 10, 2007.

(56) References Cited

OTHER PUBLICATIONS

Author Unknown, "v2.0 Ikepod Has Landed . . . again . . . ," http://qp.granularit.com/media/38876/QP24_Ikepod.pdf, 3 pages, at least as early as Apr. 25, 2015.

* cited by examiner

CLASP MECHANISM FOR WRIST-WORN DEVICES

CROSS-REFERENCE TO RELATED APPLICATION

This application is a continuation of U.S. patent application Ser. No. 15/012,831, filed Feb. 1, 2016, which is a nonprovisional patent application of and claims the benefit of U.S. Provisional Patent Application No. 62/129,659, filed Mar. 6, 2015 and titled "Sliding Clasp Mechanism for Wrist-Worn Devices," the disclosure of which are hereby incorporated herein by reference in their entirety.

FIELD

This disclosure relates generally to electronic devices, and more particularly to releasable links and clasps for bands used to secure electronic devices to persons or objects.

BACKGROUND

Conventional wearable devices, such as wristwatches, include bands that couple the device to a user. For example, a conventional wristwatch typically includes a band that attaches the watch to a user's wrist. Some bands are composed of multiple articulating links, such that the band can flex to match the shape and contours of a user's wrist. Such bands are sometimes known as "bracelet bands." In order for such bands to fit properly, they often need to be resized by adding or removing individual links from the band.

SUMMARY

Embodiments discussed herein are related to clasp mechanisms for wearable electronic devices, and, in particular, to articulable band (e.g., watch band) assemblies that include quick-release links that can be added to or removed from a band without special tools or expertise. More specifically, some embodiments described herein provide button-operated quick-release mechanisms that allow a user to couple and decouple individual links to and from a band simply by pressing a button on one of the links. Moreover, in some embodiments, biasing spring assemblies are employed that bias the quick-release links apart from one another, which causes links to forcibly separate (or "pop" open) when a user presses the button or otherwise releases the links. Thus, adding and removing individual links is made simple and convenient. Spring biasing assemblies are also provided in clasps that open and close to secure a band to a user or other object in order to increase the security and user experience of such clasps.

In some embodiments, a clasp assembly includes a latching link and a receptacle link. The latching link comprises a body having a first engagement structure; a latch member disposed at least partially within the body; and a release button disposed at least partially within the body and operatively coupled to the latch member. The receptacle link is releasably coupled to the latching link, and comprises a body having a second engagement structure configured to slidably receive the first engagement structure along a first axis, and to restrict motion of the latching link in a second axis that is perpendicular to the first axis; and a latch retention structure configured to engage with the latch member to releasably couple the receptacle link to the latching link. The clasp assembly further includes a spring assembly coupled to the latching link or the receptacle link and disposed between the latching link and the receptacle link such that the spring assembly imparts a biasing force between the latching link and the receptacle link when the latching link is releasably coupled to the receptacle link.

In some embodiments, a clasp assembly includes a clasp body having a channel and a spring member across the channel. The clasp assembly also includes a clasp cover, and a connecting arm pivotally coupled to the clasp body and the clasp cover. The clasp assembly is movable between an open configuration and a closed configuration, and, in the closed configuration, the clasp body is retained with the clasp cover, and the connecting arm engages with the spring member such that the spring member biases the clasp body away from the connecting arm.

In some embodiments, a clasp assembly includes a clasp body, a clasp cover, and a connecting arm pivotally coupled to the clasp body at a first end of the connecting arm, and pivotally coupled to the clasp cover at a second end of the connecting arm. The clasp assembly is movable between an open configuration and a closed configuration, wherein, in the closed configuration, the clasp body is retained with the clasp cover, and the connecting arm is disposed between the clasp body and the clasp cover. The connecting arm includes a groove in a surface of the connecting arm, the groove including a fulcrum therein, and a spring element having a first spring end and a second spring end opposite to the first spring end. The spring element is coupled to the fulcrum between the first and the second spring ends. The spring element is configured to engage with the clasp body such that the first spring end and the second spring end bend about the fulcrum, when the clasp assembly is in the closed configuration, to impart a biasing force between the clasp body and the connecting arm.

In some embodiments, a clasp assembly includes a clasp cover, a clasp body, and a connecting arm pivotally coupled to the clasp body at a first end of the connecting arm, and pivotally coupled to the clasp cover at a second end of the connecting arm. The clasp assembly is movable between an open configuration and a closed configuration, wherein, in the closed configuration, the clasp body is retained with the clasp cover, and the connecting arm is disposed between the clasp body and the clasp cover. The clasp body includes first and second elongate members defining a first wall and a second wall, respectively, of a channel between the two elongate members, and a first chamfer between the first wall and a first surface of the clasp body facing the clasp cover. The connecting arm includes a first compliant member having a first wedge configured to engage with the first chamfer when the clasp assembly is closed. When the clasp assembly is in the closed configuration, the first compliant member forces the first wedge against the first chamfer such that a biasing force is produced between the connecting arm and the clasp body.

In some embodiments, a clasp assembly includes a clasp body, a clasp cover, and a connecting arm assembly pivotally coupled to the clasp body at a first end of the connecting arm assembly, and pivotally coupled to the clasp cover at a second end of the connecting arm assembly. The clasp assembly is movable between an open configuration and a closed configuration, wherein, in the closed configuration, the clasp body is retained with the clasp cover, and the connecting arm assembly is disposed between the clasp body and the clasp cover. The clasp body includes first and second elongate members defining a first wall and a second wall, respectively, of a channel between the two elongate members. The connecting arm assembly includes a compliant member, a first pivot lug member coupled to a first end of the compliant member, and a second pivot lug member coupled to a second end of the compliant member opposite to the first end. The first pivot lug member engages with the clasp body, when the clasp assembly is in the closed orientation, to deform the compliant member such that the compliant member imparts a biasing force between the connecting arm assembly and the clasp body.

In some embodiments, a clasp assembly includes a clasp body, a clasp cover, and a connecting arm pivotally coupled to the clasp body at a first end of the connecting arm, and pivotally coupled to the clasp cover at a second end of the connecting arm. The clasp assembly is movable between an open configuration and a closed configuration, wherein, in the closed configuration, the clasp body is retained with the clasp cover, and the connecting arm is disposed between the clasp body and the clasp cover. A first elastomer member is coupled to one of the connecting arm or the clasp body and is at least partially disposed between the connecting arm and the clasp body such that, when the clasp assembly is in the closed position, the first elastomer member is compressed between the connecting arm and the clasp body. The elastomer member thereby imparts a biasing force between the connecting arm and the clasp body.

In some embodiments, a clasp assembly includes a clasp body comprising a first magnet coupled thereto, a clasp cover, and a connecting arm pivotally coupled to the clasp body at a first end of the connecting arm, and pivotally coupled to the clasp cover at a second end of the connecting arm. The clasp assembly is movable between an open configuration and a closed configuration, wherein, in the closed configuration, the clasp body is retained with the clasp cover, and the connecting arm is disposed between the clasp body and the clasp cover. The connecting arm includes a second magnet coupled thereto such that, when the clasp assembly is in the closed configuration, a magnetic field of the second magnet interacts with a magnetic field of the first magnet to produce a biasing force between the connecting arm and the clasp body.

In some embodiments, a link assembly includes a plurality of pivotally interconnected links forming a portion of a band. The plurality of links include a receptacle link and a latching link, wherein the latching link is configured to be releasably coupled to the receptacle link. The receptacle link includes a base surface, a channel defined on a first side by a first friction cam feature extending away from the base surface, and defined on a second side by a catch feature extending away from the base surface. The latching link includes a pivot lug at a first end of the latching link, a catch protrusion at a second end of the latching link opposite to the first end, and a second friction cam feature between the catch protrusion and the pivot lug, wherein the second friction cam feature is configured such that, when the latching link is being coupled to the receptacle link, the second friction cam feature slides over the first friction cam feature of the receptacle link and orients the latching link such that the catch protrusion engages with the catch feature to releasably couple the receptacle link to the latching link.

Other embodiments are disclosed herein. The features, utilities and advantages of various embodiments of this disclosure will be apparent from the following description of embodiments as illustrated in the accompanying drawings.

DESCRIPTION

Wearable devices, such as watches, are typically secured to a user or to an object with a band. Some bands are composed of multiple, pivotally connected links that allow the band to flex to conform to a wearer's wrist. Discussed herein are articulable watch band link assemblies that include quick-release links that allow users to quickly and easily add and remove links to a watch band. The quick-release mechanisms may be incorporated into the links in such a manner that they do not interfere with the operation or appearance of the band. For example, as described herein, buttons and other mechanical components of the quick-release mechanisms may be positioned so that they face the user's body when they are worn, thus ensuring that the aesthetic appearance of the watch band is not compromised.

Additionally, watch bands may include clasps that allow the band to open and close to facilitate application and removal of the device, as well as to secure the device when it is being worn. Such clasps suffer potential drawbacks, however. For example, because watch band clasps have to be very secure so that they do not accidentally release, they may be difficult to open and close. Accordingly, also described herein are clasp mechanisms that may be more secure and easier to operate.

Various embodiments are described herein with respect to the figures. In particular, FIGS. 1A-9 relate to releasable links and link assemblies, including embodiments where the releasable links are configured to slidably engage with one another and include spring mechanisms to bias the links toward an open configuration. FIGS. 10A-12C relate to releasable links and link assemblies, including embodiments where the releasable links use friction cam features and clasps to couple to one another. FIGS. 13A-21C relate to various embodiments of clasps that include mechanisms to bias the clasp toward an open configuration. Each of the figures is discussed herein.

Releasable Link Assemblies

Figure 1A:
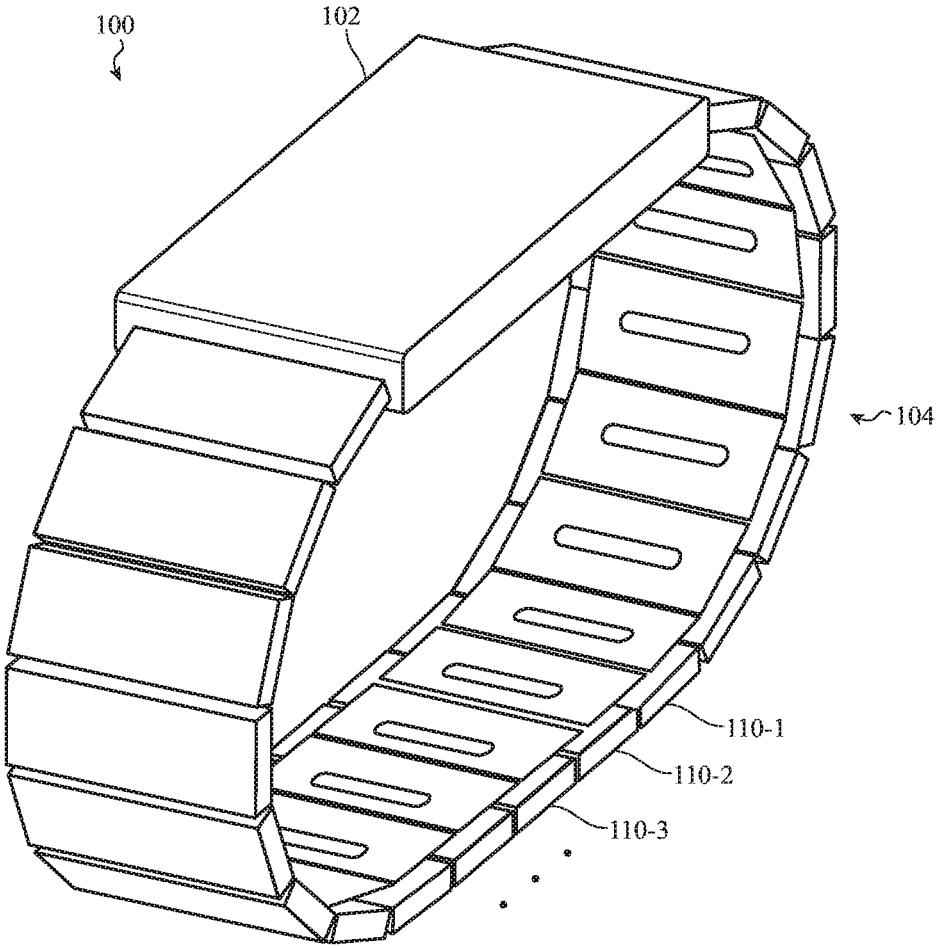
FIG. 1A depicts an illustrative perspective view of one example of a wearable electronic device.

Referring now to FIG. 1A, there is shown an illustrative perspective view of one example of a wearable device 100 (also referred to as "device 100"). The device 100 may be any appropriate wearable device, including an electrical or mechanical wrist watch, an electronic computing device, a health monitoring device, a timekeeping device, a stopwatch, etc.

In some embodiments, the device 100 may be an electronic device configured to provide health-related information or data such as but not limited heart rate data, blood pressure data, temperature data, oxygen level data, diet/nutrition information, medical reminders, health-related tips or information, or other health-related data. The device 100 may optionally convey the health-related information to a separate electronic device such as a tablet computing device, phone, personal digital assistant, computer, and so on. In addition, the device 100 may provide additional information, such as but not limited to, health, statuses of externally connected or communicating devices and/or software executing on such devices, messages, video, operating commands, and so forth (and may receive any of the foregoing from an external device).

The device 100 may include a housing 102 that forms an outer surface or partial outer surface and protective case for the internal components of the wearable electronic device 100. The housing 102 may also include mounting features formed on opposite ends to connect a wearable band 104 (also referred to as "band 104") to the housing 102. As shown in FIG. 1A, and discussed herein, the band 104 may be composed of or otherwise include multiple links 110 that are pivotally coupled to form all or a portion of the band 104. The band 104 may also include a clasp that opens and closes to facilitate application and removal of the device 100 from a user. The band 104 may be used to secure the device 100 to a user, or to any other object capable of receiving the device 100. In a non-limiting example where the device 100 is a watch, the band 104 may secure the watch to a user's wrist. In other non-limiting examples, the band 104 may secure the device 100 to or within another part of a user's body.

In some embodiments, some or all of the links 110 are releasable links that can be coupled to and decoupled from one another. In some embodiments, the band 104 is composed entirely of releasable links. In some embodiments, however, the band 104 includes both releasable links as well as conventional, non-releasable links. In some embodiments, releasable links are included with a portion of a band that is not composed of articulating links. For example, a band may include one or more portions made from leather, fabric, mesh, or another material, in conjunction with a plurality of releasable links.

By providing several releasable links in a watch band, a user is able to remove as many links (or add as many additional links) as is necessary to customize the fit of the band. Moreover, in some embodiments, the release mechanisms, such as buttons, of the releasable links are located on the inside surface of the links (e.g., the portion of the links that contact the wearer's skin) so that the outward appearance of the releasable links may be made identical to any non-releasable links.

Figure 1B:
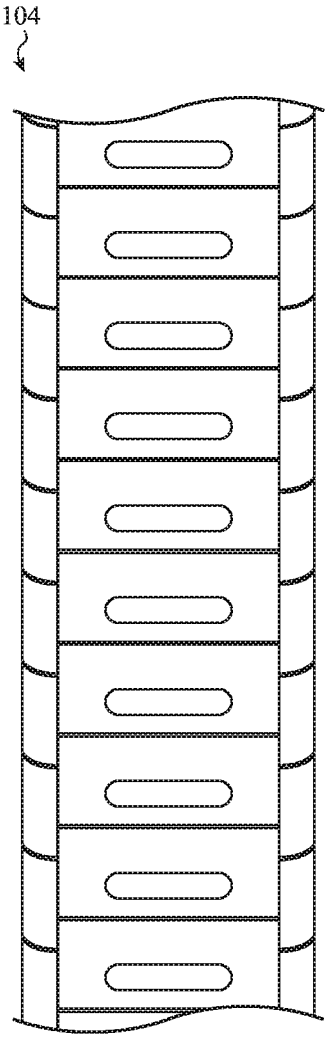
FIGS. 1B-1C depict plan views of the band of the wearable electronic device of FIG. 1A.
Figure 1C:
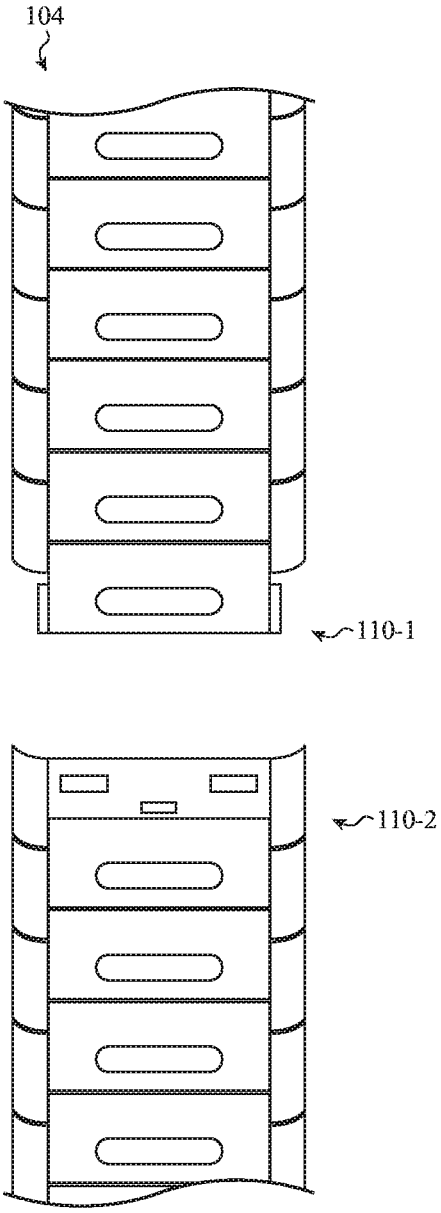

FIGS. 1B and 1C depict plan views of the interior portion of the band 104 (e.g., the portion that contacts a wearer's skin), illustrating the band 104 when all of the releasable links are coupled together (FIG. 1B), and when one releasable link 110-1 is decoupled from another releasable link 110-2 (FIG. 1C).

Figure 2:
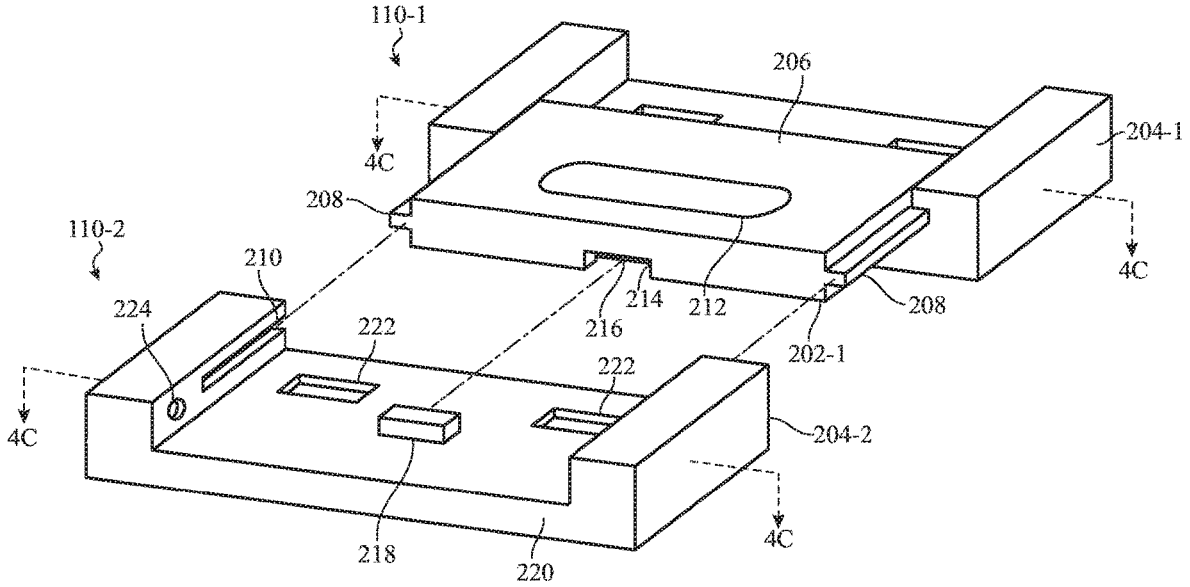
FIG. 2 depicts an illustrative perspective view of components of releasable link assemblies, in accordance with some embodiments.

FIG. 2 depicts an illustrative perspective view of a releasable link assembly 110-1 (also referred to as a "releasable link 110-1," or simply a "link 110-1"), and a portion of a complimentary releasable link assembly 110-2. Each releasable link assembly 110 includes a latching link 202 and a receptacle link 204. In a given releasable link assembly 110-1, the latching link 202-1 is pivotally coupled to the receptacle link 204-1. As will be apparent from the figures and description, the latching link of a given releasable link assembly is configured to releasably couple to the receptacle link of another releasable link assembly. Similarly, the receptacle link of the given releasable link assembly is configured to releasably couple to the latching link of yet another releasable link assembly. In this way, a band (or a portion of a band comprising multiple links) can be formed by coupling multiple identical releasable link assemblies to one another. Any of the releasable links can therefore be removed, or new links added, in order to customize the size of the band.

The latching link 202-1 includes a body 206. The body 206 may be formed from any suitable material, including but not limited to metal, amorphous metal/metallic alloys, ceramic, and plastic.

The body 206 includes a first engagement structure 208. The first engagement structure 208 is configured to slidably engage with a second engagement structure 210 on a receptacle link of another releasable link assembly (e.g., the receptacle link 204-2). For example, as shown in FIG. 2, the first engagement structure 208 is a slide feature that is configured to be received into the second engagement structure 210 (a channel) of the receptacle link 204-2. In some embodiments, the locations of the slide feature and the channel are swapped, so that the slide feature is disposed on the receptacle link, and the channel is disposed on the latching link. The first and second engagement structures align the latching link with the receptacle link so that the latching mechanisms, described below, properly engage and retain to one another. Further, the slide feature and the channel define a sliding axis between the releasable link assemblies, and also provide the physical support that retains the links together in a direction perpendicular to the sliding axis.

The latching link 202-1 also includes a release button 212. The release button 212 is operatively coupled to a latch member such that operation of the release button 212 when the latching link 202-1 is releasably coupled to a complimentary receptacle link causes the latch member to unlatch from the receptacle link. The latch member is described herein with reference to FIGS. 4A-4B.

Figure 4A:
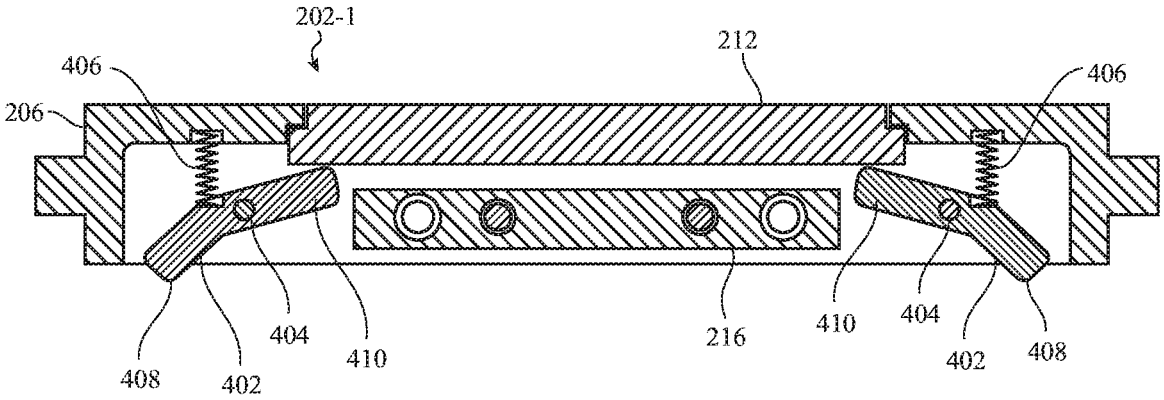
FIGS. 4A-4D depict illustrative cross-sectional views of a releasable link assembly, in accordance with some embodiments.
Figure 4B:
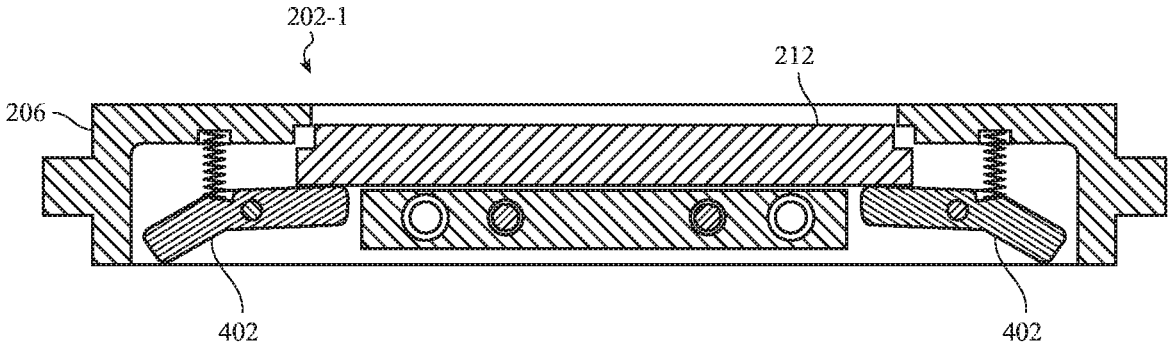
Figure 4C:
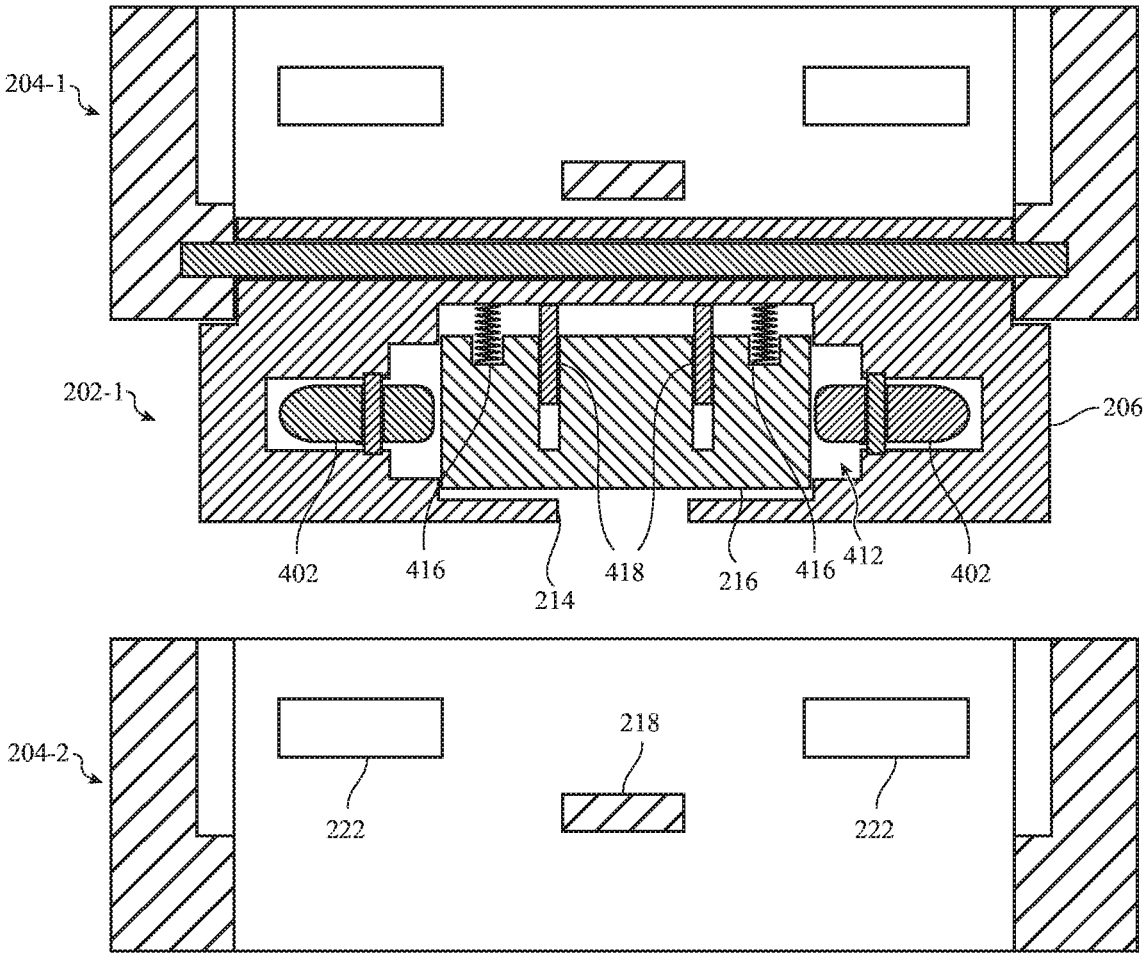
Figure 4D:
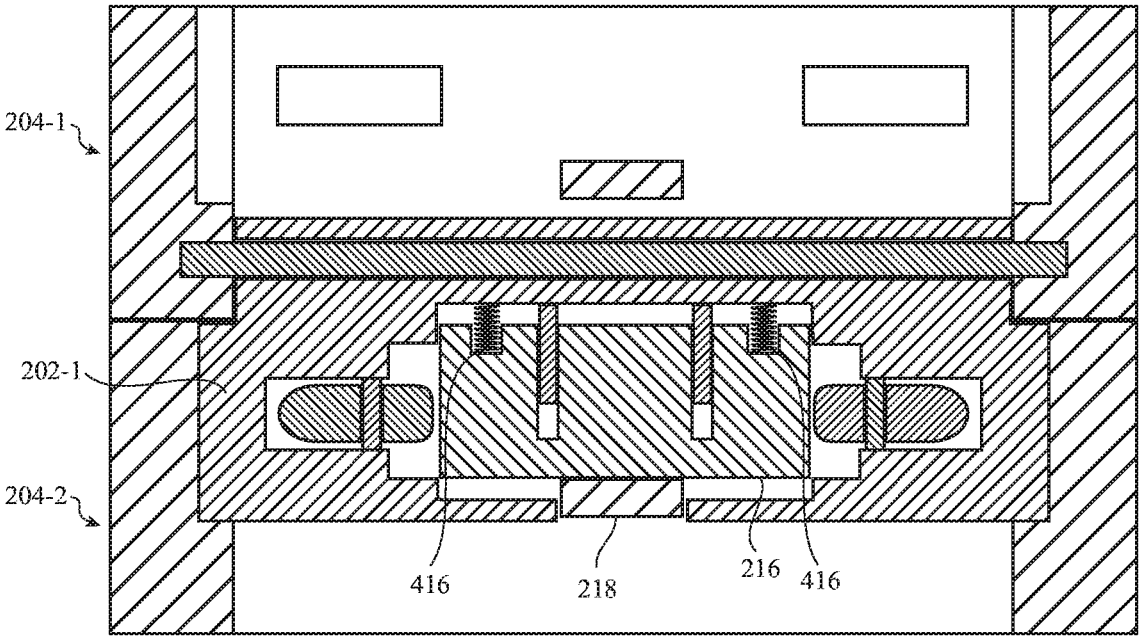

The body 206 also includes an aperture 214 that exposes a portion of a plunger 216 of a spring assembly 412 (discussed with respect to FIGS. 4C-4D). The spring assembly 412 is configured to provide a biasing force between the latching link 202-1 and the receptacle link 204-2 when the latching and receptacle links are releasably coupled to one another. The biasing force may provide several benefits. For example, the biasing force can press the latching member 402 of the latching link 202-1 against a latch retention structure 222 in the receptacle link 204-2, resulting in a more secure coupling between the links. Moreover, the biasing force may force the latching link 202-1 and the receptacle link 204-2 apart when the user presses the release button 212, providing immediate physical separation between the two links. This is particularly beneficial because it can be difficult for a user to simultaneously apply both a pressing force on the release button 212 and a pulling force between the links, which may be necessary if a biasing force were not provided by a spring assembly.

The aperture 214 is configured to allow an ejection block 218 on the receptacle link to contact and displace the plunger 216, thereby compressing or otherwise straining a resilient component (e.g., a coil spring) in the spring assembly. The interaction between the ejection block 218 and the plunger 216 is addressed with respect to FIGS. 4C-4D.

The receptacle link 204-2 includes a body 220, which, like the body 206 of the latching link 202-1, may be formed from any suitable material. In some embodiments, the body 220 of the receptacle link 204-2 is formed from the same material as the body 206 of the latching link 202-1, though this need not be the case.

The receptacle link 204-2 also includes one or more latch retention structures 222 (or openings 222) that are configured to engage with the latch member 402 of the latching link to releasably couple the receptacle link 204-2 to the latching link 202-1. For example, as shown in FIGS. 4A-4B, the one or more latch retention structures are openings (e.g., blind holes) in a surface of the receptacle link body 220. As shown in FIG. 4A-4B, a portion of the latch member 402 projects into the opening 222 in order to retain the latching link to the receptacle link in a direction parallel to the sliding axis. In other words, the latch member 402 latches on to the latch retention structures 222 to releasably couple the latching link 202-1 to the receptacle link 204-2.

The receptacle link 204-2 also includes pivot joints 224 that pivotally couple the receptacle link 204-2 to another latching link (not shown). In some embodiments, the latching link includes protrusions that are received into the pivot joints 224. In some embodiments, the latching link and the receptacle link are pivotally coupled via a spring pin that passes through an opening in the latching link and engages with the pivot joints 224 on the receptacle link 204-2. While the pivot joints 224 are described with respect to the receptacle link 204-2, it will be understood that the receptacle link 204-1 (shown coupled to the latching link 202-1) includes the same or similar structures, as any respective receptacle link of one type is essentially identical to any other receptacle link of the same type.

Figure 3A:
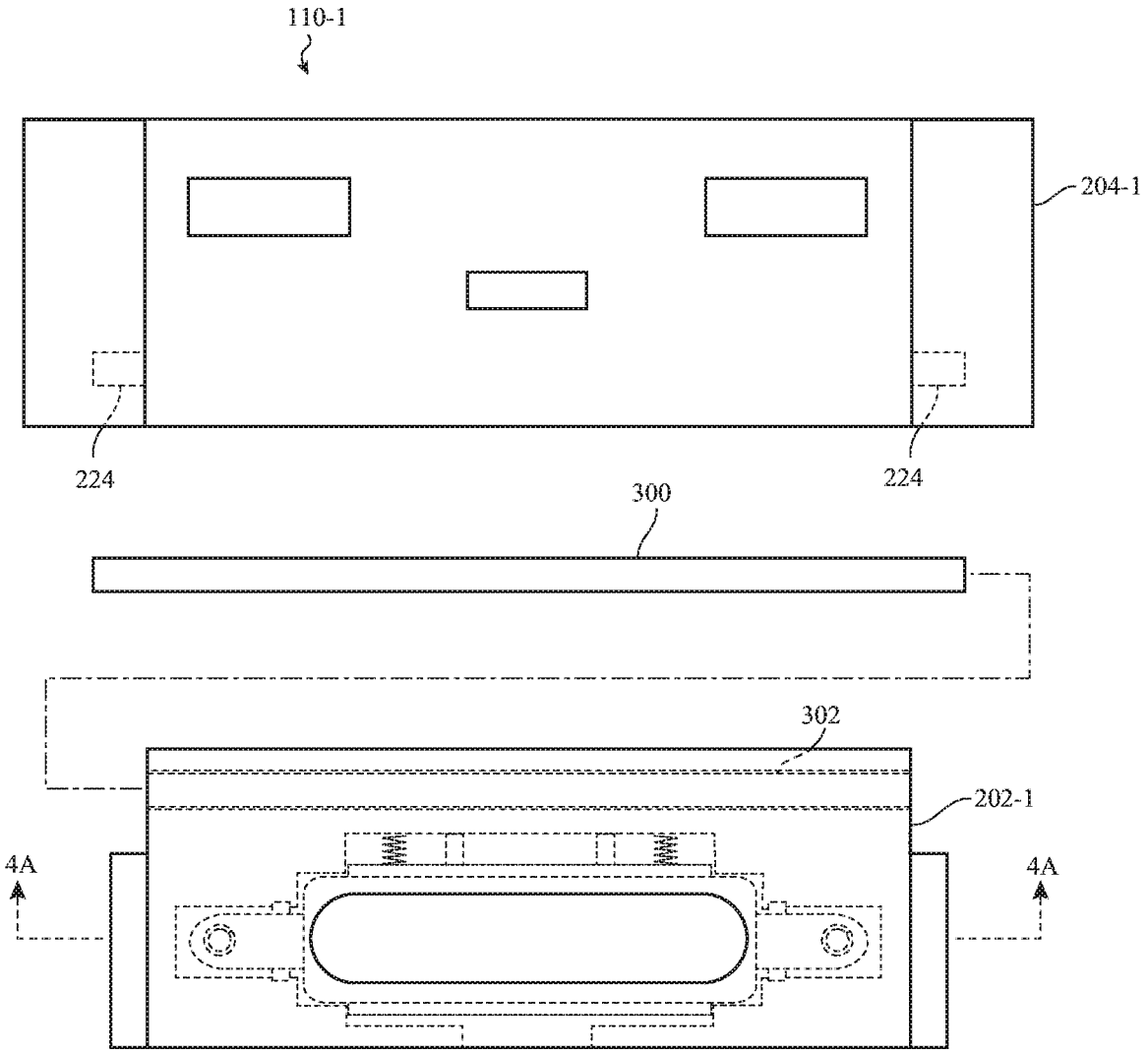
FIGS. 3A-3B depict illustrative plan views of a releasable link assembly, in accordance with some embodiments.
Figure 3B:
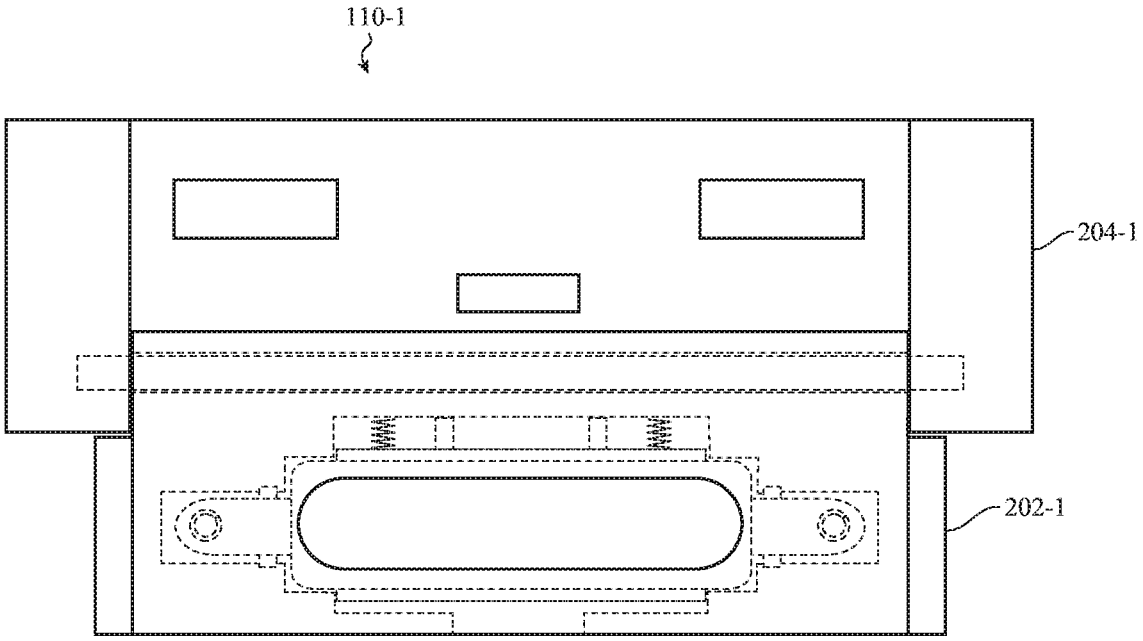

FIGS. 3A-3B are top plan views depicting a releasable link assembly 110-1, in accordance with some embodiments. FIGS. 3A-3B show several interior components of the latching link 202-1 in phantom lines. These components will be discussed with respect to FIGS. 4A-4D.

FIG. 3A illustrates the latching link 202-1 separated from the receptacle link 204-1 to which it is pivotally attached to form the releasable link assembly 110-1, as well as a pivot pin 300 that is used to couple the latching link 202-1 to the receptacle link 204-1. In particular, the pivot pin 300 is placed inside a channel 302 (e.g., a cylindrical opening) in the latching link 202-1, and ends of the pivot pin 300 are received into pivot joints 224 in the receptacle link 204-1. In some embodiments, the pivot pin 300 is a spring pin, such as the kind that are commonly used to couple watch bands to watches.

FIG. 3B illustrates the latching link 202-1 pivotally attached to the receptacle link 204-1, thus forming an assembled releasable link assembly 110-1.

FIG. 4A is a cross-sectional view of the latching link 202-1, taken through line 4A-4A in FIG. 3A. Latch members 402 are disposed inside an opening in the body 206 of the latching link 110-1. The latch members 402 are pivotally coupled to the latch body via pivots 404. Springs 406 bias the latch members 402 in a "latched" position, which corresponds to the engagement portions 408 of the latch members 402 extending below the bottom surface of the body 206. The engagement portions 408 of the latch members are configured to engage with the latch retention structures 222 of the receptacle link 204-2. In some embodiments, where the latch retention structures 222 are openings in a surface of the receptacle link 204-2, the engagement portions of the latch members extend into the openings in order to retain the latching link to the receptacle link.

When the release button 212 is pressed downward, the release button 212 (or a feature or component of or coupled to the release button 212) pushes against actuation portions 410 of the latch members 402, causing the latch members 402 to pivot about the pivots 404 and raise the engagement portions 408, as shown in FIG. 4B. In some embodiments, the engagement portions 408 are raised far enough that they retract completely from the latch retention structures. Thus, when the latching link 202-1 is removably coupled to the receptacle link 204-2 via the latch members 402, pressing the release button 212 causes the latch members 402 (and, more specifically, the engagement portions 408 of the latch members) to disengage from the latch retention structures 222, thereby allowing the user to disconnect the latching link 202-1 from the receptacle link 204-2. Moreover, once the latch members 402 disengage from the latch retention structures 222, the springs of the spring assembly 412 (FIGS. 4C-4D) are allowed to freely decompress, thus imparting a biasing force between the latching link and the receptacle link, resulting in the links being forcibly separated from one another (e.g., they "pop" apart).

In some embodiments, the engagement portions 408 of the latch members 402 are contoured or otherwise configured such that the latch members 402 are pivoted about the pivots 404 automatically when a user couples the latching link 202-1 to the receptacle link 204-2 (by sliding them together). Thus, a user need not press the release button 212 when attempting to couple the links together, as the process of sliding the latching link 202-1 into the receptacle link 204-2 provides force of a sufficient magnitude and direction to pivot the latch members 402 and allow them to engage with the latch retention structures 222.

The latching link 202-1 also includes a plunger 216. The plunger 216 is part of the spring assembly 412, which imparts a biasing force between the latching link 202-1 and a receptacle link.

FIG. 4C depicts a cross-sectional view of a releasable link assembly 110-1 (including the receptacle link 204-1 and the latching link 202-1) and a receptacle link 204-2 of a complimentary releasable link assembly 110-2, in accordance with some embodiments, taken along the line 4C-4C in FIG. 2. The latching link 202-1 in FIGS. 4C-4D corresponds to the latching link 202-1 shown and described with respect to FIGS. 2 and 4A-4B.

As noted above, the latching link 202-1 includes a spring assembly 412. In some embodiments, the spring assembly 412 includes a plunger 216, one or more springs 416, and one or more guide rods 418 that align the plunger 216 with respect to the body 206 of the latching link 202-1.

The receptacle link 204-2 includes latch retention structures 222 and an ejection block 218. The ejection block 218 is positioned and configured to pass through the aperture 214 of the body of the latching link 202-1 when the latching link 202-1 is being removably coupled to the receptacle link 204-2. FIG. 4D illustrates the latching link 202-1 of the releasable link assembly 110-1 releasably coupled to the receptacle link 204-2. In this figure, the ejection block 218 has contacted the plunger 216 to compress the springs 416 and, thus, impart a biasing force between the receptacle link 204-2 and the latching link 202-1.

Figure 5:
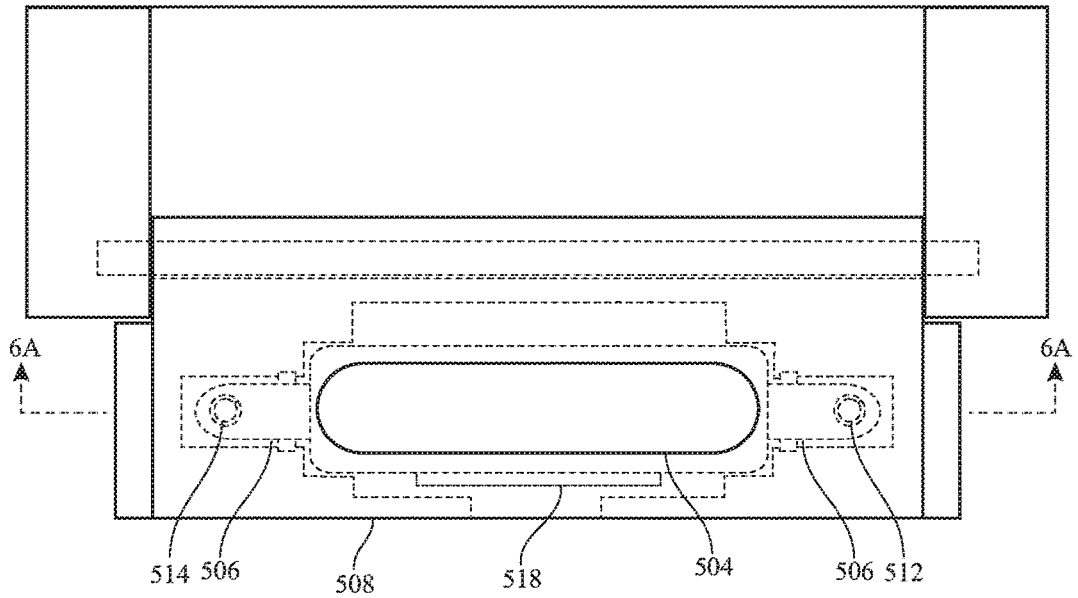
FIG. 5 depicts an illustrative plan view of a releasable link assembly, in accordance with some embodiments.
Figure 6A:
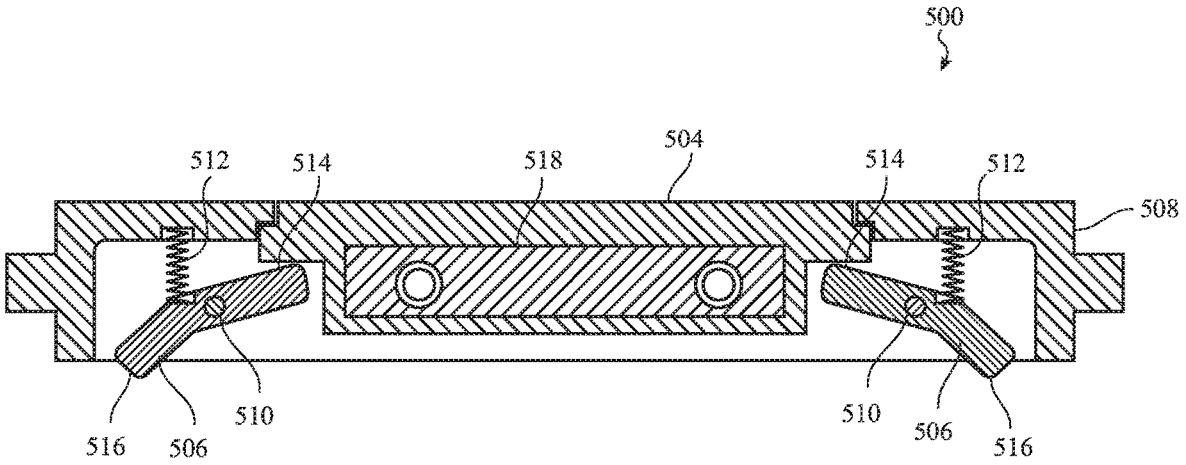
FIGS. 6A-6C depict illustrative cross-sectional views of a releasable link assembly, in accordance with some embodiments.
Figure 6B:
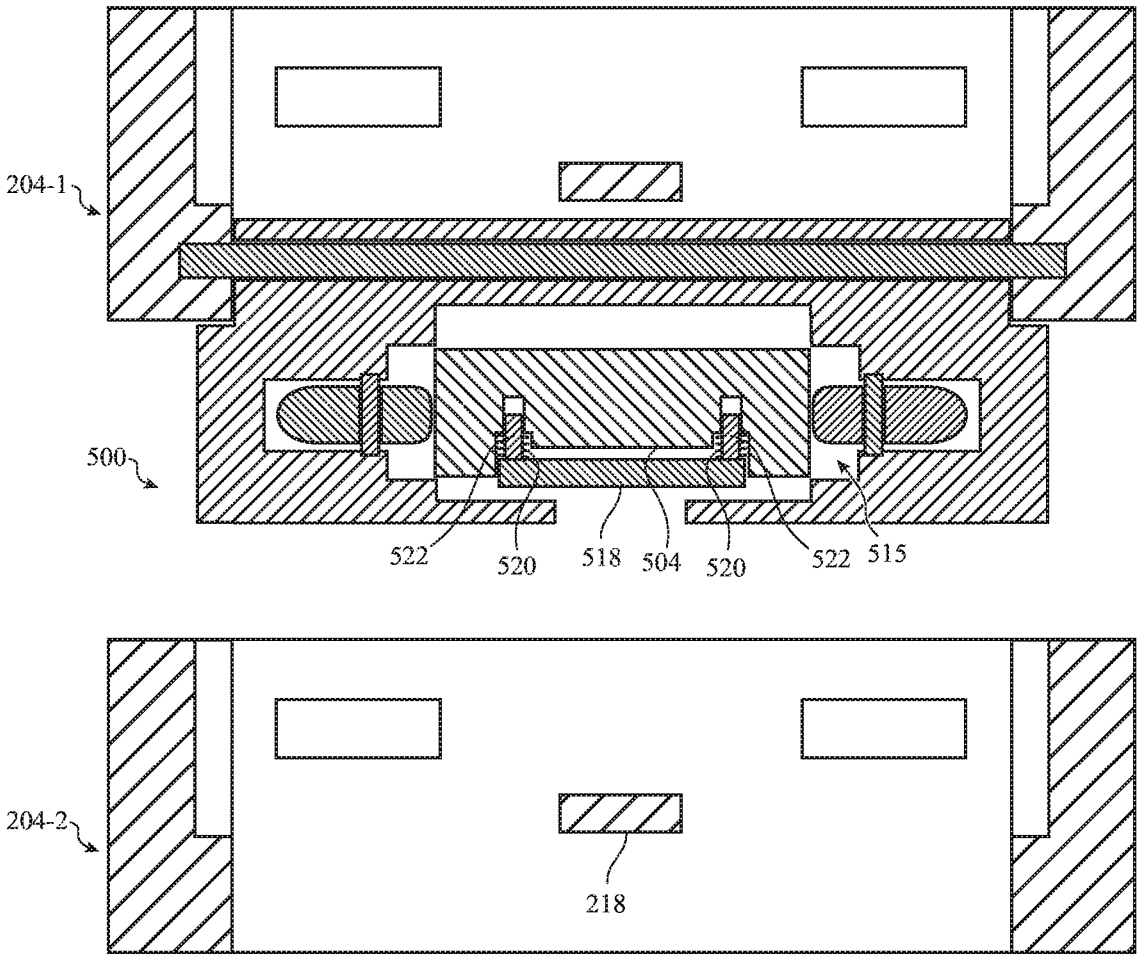
Figure 6C:
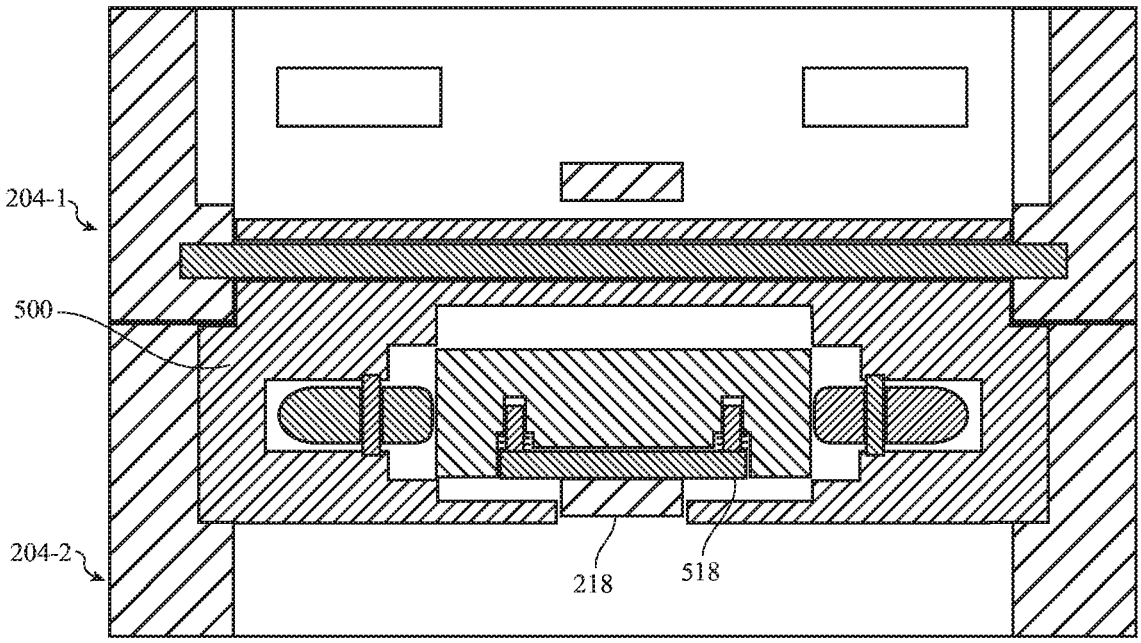

FIGS. 5-6C depict another embodiment of a latching link (latching link 500). In particular, whereas the latching link 202-1 in FIGS. 2-4D includes a spring assembly 412 that is separate from and disposed below the release button 212 (see, e.g., FIGS. 4A-4B), the spring assembly 502 in the latching link 500 in FIGS. 5-6C is built into a body portion of the release button 504. In some embodiments, both the latching link 202-1 and the latching link 500 may be used with the same receptacle link 204-2.

FIG. 5 is a top plan view depicting the latching link 500, in accordance with some embodiments. The latching link 500 in FIG. 5 includes a body 508, a release button 504 and latch members 506 disposed at least partially within the body 504, and a plunger 518 disposed at least partially within the release button 504.

FIG. 6A is a cross-sectional view of the latching link 500 of FIG. 5 taken through line 6A-6A in FIG. 5. As shown in FIG. 6A, latch members 506 are disposed inside an opening in the body 508. The latch members 506 are pivotally coupled to the latch body via pivots 510. Springs 512 bias the latch members 506 in a "latched" position, such that the engagement portions 516 of the latch members 506 extend below the bottom surface of the body 508. The engagement portions 516 of the latch members are configured to engage with the latch retention structures 222 of the receptacle link 204-2 (FIGS. 2, 4C). In some embodiments, where the latch retention structures 222 are openings in a surface of the receptacle link 204-2, the engagement portions 516 of the latch members 506 extend into the openings in order to retain the latching link 500 to the receptacle link 204-2.

Similar to the discussion above, when the release button 504 is pressed downward, the release button 504 pushes against actuation portions 514 of the latch members 506, causing the latch members 506 to pivot about the pivots 510 and raise the engagement portions 516. In this way, the latch members 506 are disengaged from the latch retention structures, and the latching link 500 can be disconnected from the receptacle link 204-2.

The latching link 500 also includes a plunger 518 coupled to, and disposed partially within, the release button 504. The plunger 518 is positioned such that the plunger 518 is at least partially in contact with the ejection block 218 both when the release button is pressed and when it is not. Accordingly, while the plunger 518 may slide against a surface of the ejection block 218 when the release button moves up and down within the latching link, the plunger 518 imparts a biasing force against the ejection block 218 throughout the button's travel.

FIG. 6B depicts a cross-sectional view of a releasable link assembly that includes the latching link 500 pivotally coupled to the receptacle link 204-1, and a complementary receptacle link (e.g., the receptacle link 204-2) of a complimentary releasable link assembly, in accordance with some embodiments. While the latching link 202-1 has been replaced with the latching link 500 in FIG. 6B, the receptacle links 204-1 and 204-2 are the same as those depicted in FIGS. 2-4D.

FIG. 6C illustrates the releasable link assembly that includes the latching link 500 when the latching link is releasably coupled to the receptacle link 204-2. Specifically, FIG. 6C illustrates how the ejection block 218 interacts with the plunger 518 to displace the plunger 518, and thereby produce a biasing force between the latching link 500 and the receptacle link 204-2.

Similar to the spring assembly 412 described above, the spring assembly 515 includes a plunger 518, one or more springs 520, and one or more guide rods 522 that align the plunger 518 with respect to a body portion of the release button 504. Despite being built into the release button 504, the spring assembly 515 operates similarly to the spring assembly 412. In particular, the plunger 518 is positioned such that the plunger 518 is at least partially in contact with the ejection block 218 when the latching link 500 is removably coupled to a receptacle link. When the release button is actuated while the links are removably coupled, the plunger 518 imparts a biasing force against the ejection block 218, thus causing the latching link 500 to be forcibly separated from the receptacle link 204-2 (e.g., they "pop" apart).

Figure 7A:
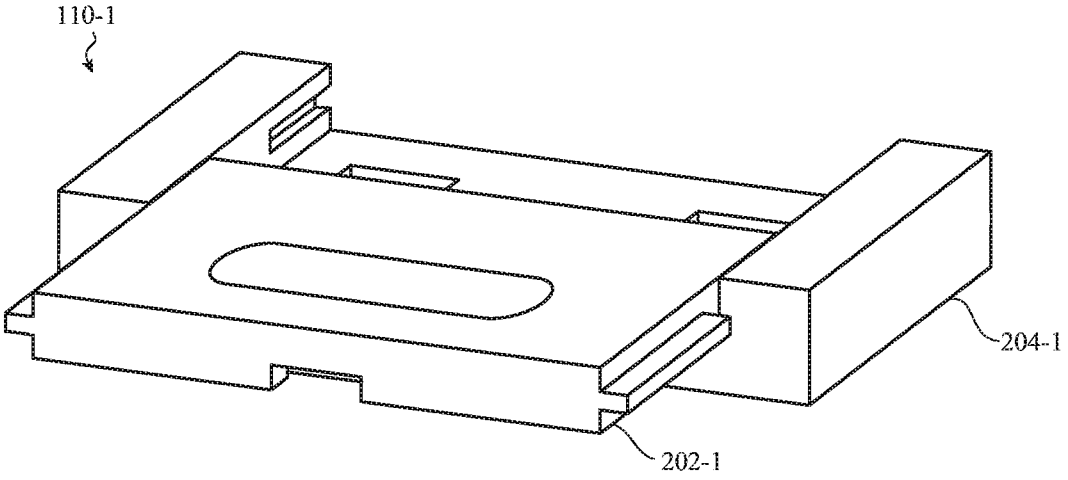
FIGS. 7A-7B depict illustrative perspective views of a releasable link assembly, in accordance with some embodiments.
Figure 7B:
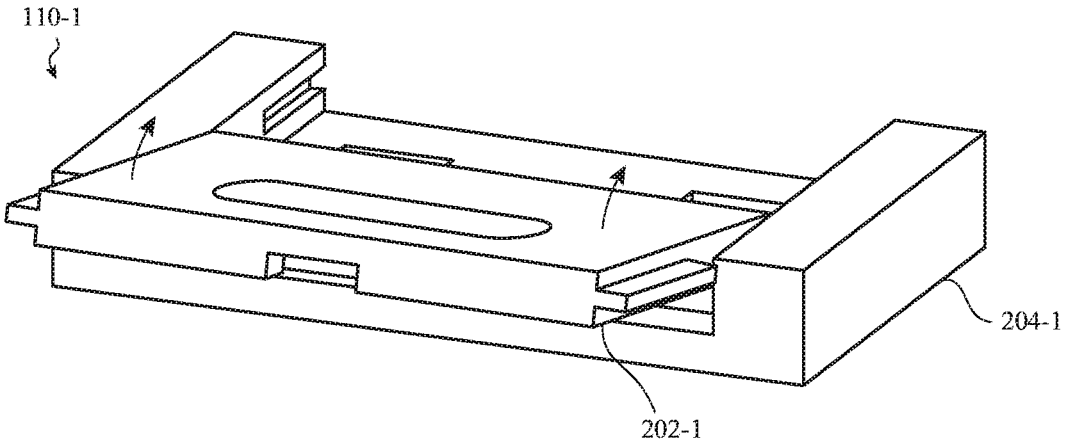

FIGS. 7A-7B depict perspective views of a releasable link assembly 110-1, in accordance with some embodiments, illustrating a latching link 202-1 pivotally coupled to a receptacle link 204-1. Specifically, FIG. 7A illustrates the link assembly 110-1 in a substantially aligned orientation, and FIG. 7B illustrates the latching link 202-1 pivoted clockwise about the pivot pin 300 (shown in FIG. 3A, not shown in FIG. 7A), resulting in the latching link 202-1 positioned at an angle with respect to the receptacle link 204-1.

As noted above, a link assembly is made up of a plurality of releasable link assemblies 110-1. Accordingly, the ability of a latching link to pivot with respect to the receptacle link to which the latching link is coupled allows the watch band to flex and conform to a wearer's wrist, even though the releasable coupling between separate link assemblies (e.g., the link between the latching link 202-1 and the receptacle link 204-2) may be inflexible.

Figure 8:
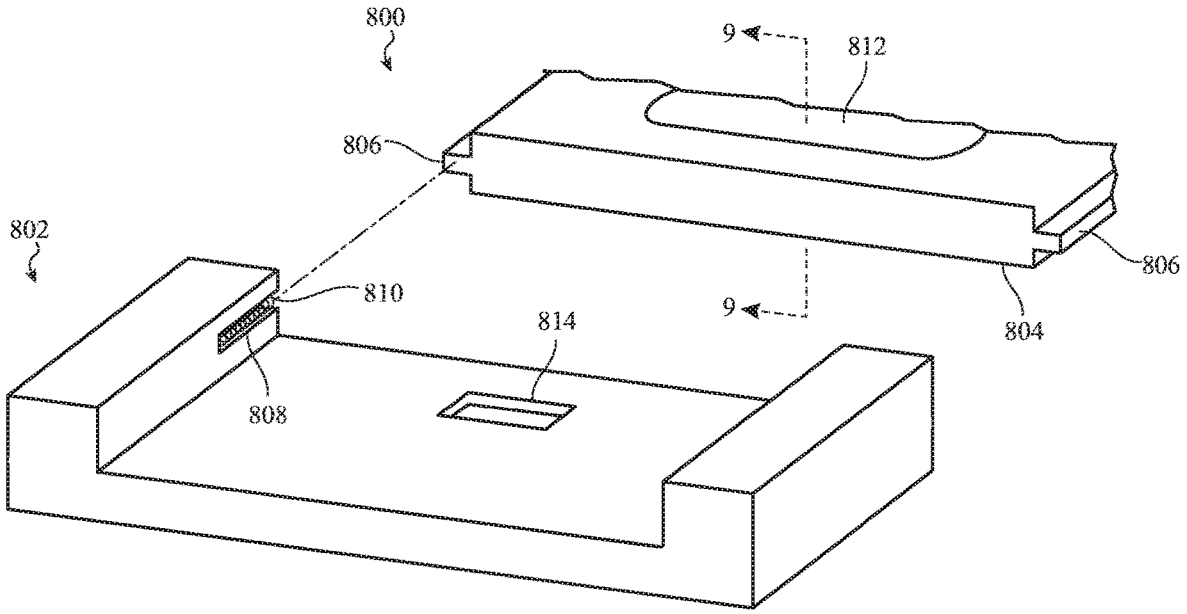
FIG. 8 depicts an illustrative perspective view of a releasable link assembly, in accordance with some embodiments.

FIG. 8 illustrates yet another embodiment of a latching link 800 that may be included in a releasable link assembly, as well as a receptacle link 802 to which the latching link 800 can be releasably coupled. Like the latching link assemblies described above, the latching link 800 includes a body 804. The body 804 includes a first engagement structure 806 that is configured to slidably engage with a second engagement structure 808 on the receptacle link 802. For example, as shown in FIG. 8, the first engagement structure 806 is a slide feature that is configured to be received into the channel of the receptacle link 802 (the second engagement structure 808). In some embodiments, the locations of the slide feature and the channel are swapped, so that the slide feature is disposed on the receptacle link 802, and the channel is disposed on the latching link 800.

A spring 810 (or other resilient component) is disposed in the second engagement structure 808 (as shown), or is coupled to the slide (not shown), such that the spring is compressed when the latching link 800 is removably coupled to the receptacle link 802. In some embodiments, the receptacle link 802 and the latching link 800 each include multiple complementary engagement structures, and each engagement structure includes a spring 810.

Similar to the spring assemblies 412, 515 described above, the spring (or springs) 810 in FIG. 8 imparts a biasing force between the latching link 800 and the receptacle link 802 that forcibly separates the latching link 800 from the receptacle link 802 when the latching mechanism is released, and may also increase the security of the connection between the links by applying a force to the latch members and corresponding latch retention structures that increases the latching force therebetween.

Moreover, while the spring 810 is shown as being disposed within the channel in FIG. 8, springs may instead or additionally be coupled to any surface, feature, or portion of a receptacle link or a latching link, so long as the latching and receptacle links engage with the spring such that the spring imparts a biasing force between the links. Moreover, the spring need not be a coil spring. Rather, any appropriate resilient member, structure, or assembly may be used to impart the biasing force. For example, a leaf spring may be disposed in the channel and protrude into the channel, such that the engagement structure 806 bends the leaf spring when the latching link 800 is releasably coupled to the receptacle link 802.

The latching link 800 also includes a release button 812. The release button 812 is operatively coupled to a latch member such that operation of the release button 812 when the latching link 800 is releasably coupled to a complimentary receptacle link 802 causes the latch member to unlatch from the receptacle link.

Figure 9:
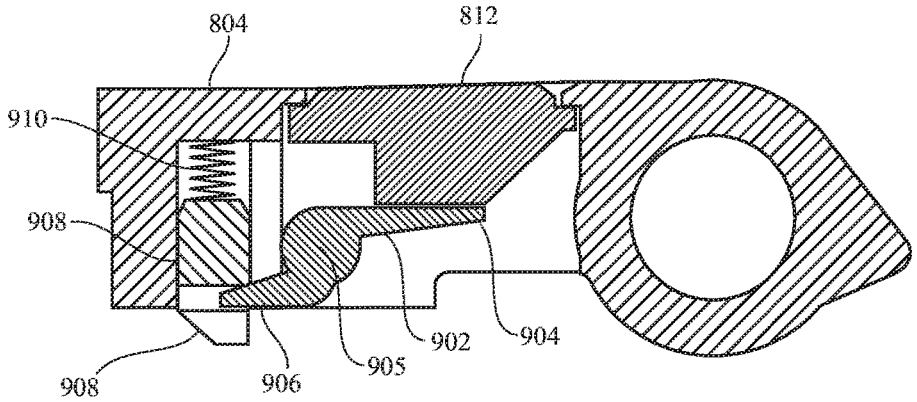
FIG. 9 depicts an illustrative cross-sectional view of components of a releasable link assembly, in accordance with some embodiments.

The receptacle link 802 includes one or more latch retention structures 814 (or openings 814) that are configured to engage with one or more latch members of the latching link 800 (shown and discussed with respect to FIG. 9). In some embodiments, the latch retention structure 814 is an opening (e.g., a blind hole) that is machined or otherwise formed into the receptacle link 802.

FIG. 9 depicts a cross-sectional view of the body 804 of the latching link 802 from FIG. 8, taken along the line 9-9 in FIG. 8, illustrating the latching mechanism disposed within the body 804. The latching link 800 includes a release button 812 that, when actuated (e.g., pressed downwards) when the latching link 800 is coupled to a receptacle link 802, causes the links to decouple from one another.

The latching link 800 also includes a latching member 908. The latching member 908 is configured to engage with the latch retention structure 814 of the receptacle link 802 so as to releasably couple the latching link 800 to the receptacle link 802. The latching member 908 is coupled to a spring 910 that imparts a biasing force between the latching member 908 and the body 804 of the latching link 800 to keep the latching member 908 pressed downward. This biasing force helps keep the latching member 800 engaged with the complementary retention structure 814 with which it engages to releasably couple the links together.

The latching link 800 also includes a latch control arm 902. The latch control arm 902 is pivotally coupled to the body 804 about a pivot axis 905, and has a first portion 904 that engages with the release button 812 and a second portion 906 that engages with the latching member 908. More specifically, the first portion 904 of the latch control arm 902 is configured to be displaced downward by the release button 812 (or a component linked to or otherwise coupled to the release button 812) when the release button is depressed. The downward motion of the first portion 904 of the latch control arm causes the latch control arm 902 to pivot about the pivot axis 905, resulting in the second portion 906 of the latch control arm being raised. The second portion 906 of the latch control arm is coupled to the latching member 908 (or to a component linked to or otherwise coupled to the latching member 908). Thus, when the second portion of the latch control arm 902 is raised, the latching member 908 is also raised. The raising of the latching member 908 disengages the latching member 908 from the latch retention structure 814 of the receptacle link 802, and allows the latching link 800 to be decoupled from the receptacle link 802.

Figure 10A:
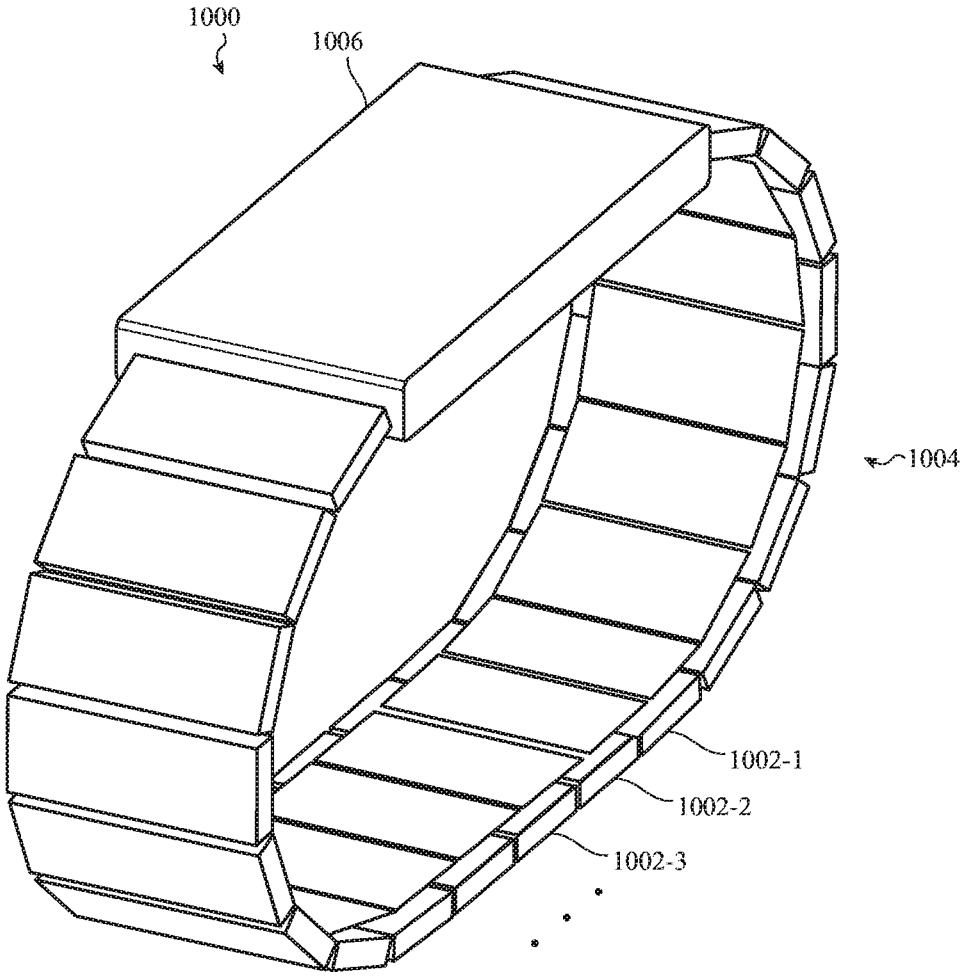
FIG. 10A depicts an illustrative perspective view of one example of a wearable electronic device.

Releasable latch assemblies that do not have release buttons and spring assemblies may also be provided. For example, FIG. 10A illustrates an illustrative perspective view of one example of a wearable device 1000 (also referred to as "device 1000") that includes a band 1004 that includes a plurality of releasable link assemblies 1002 that are releasably coupled to one another using a linking mechanism, as described herein. In particular, instead of a user pressing on a release button to unlatch a releasable link assembly from another, and thus allowing the user to slide the links apart, the releasable link assemblies in FIGS. 10A-12C are decoupled by a user lifting and/or pivoting a latching link so as to unclip the latching link from a receptacle link.

The device 1000 may include a housing 1006 that includes mounting features formed on opposite ends of the housing 1006, where the mounting features connect the housing to a wearable band 1004 (also referred to as "band 1004"). The band 1004 may include (or be entirely composed of) releasable link assemblies 1002.

Figure 10B:
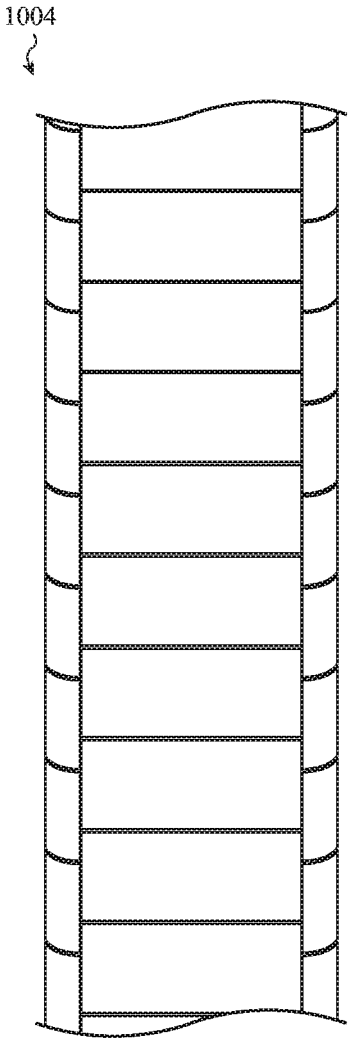
FIGS. 10B-10C depict plan views of a band of the wearable electronic device of FIG. 10A.
Figure 10C:
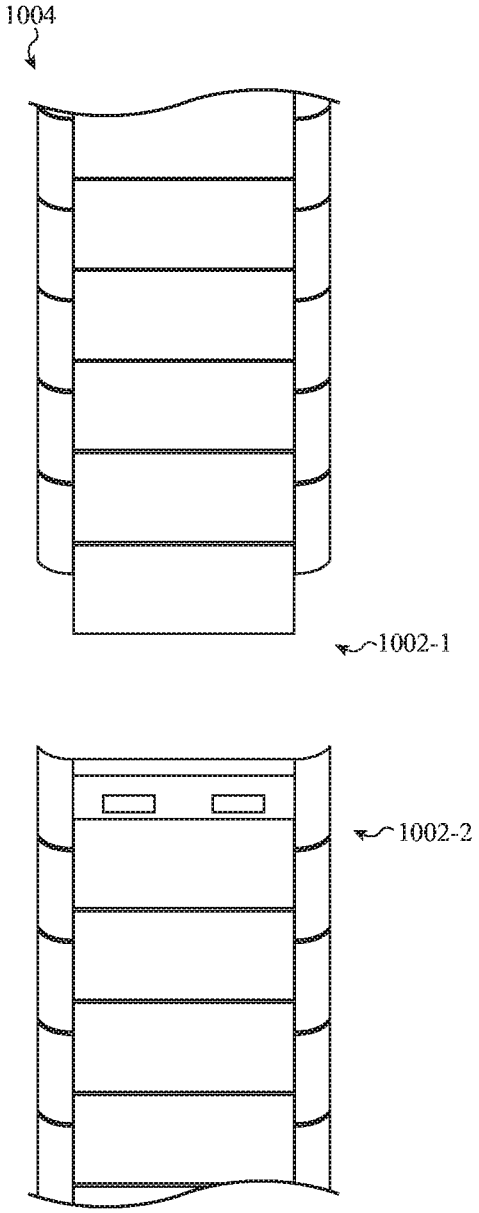

FIGS. 10B and 10C depict plan views of the interior portion of the band 1004 (e.g., the portion of the band that contacts a user's person), illustrating the band 1004 when all of the releasable links are coupled together (FIG. 10B), and when one releasable link 1002-1 is decoupled from another releasable link 1002-2 (FIG. 10C).

Figure 11:
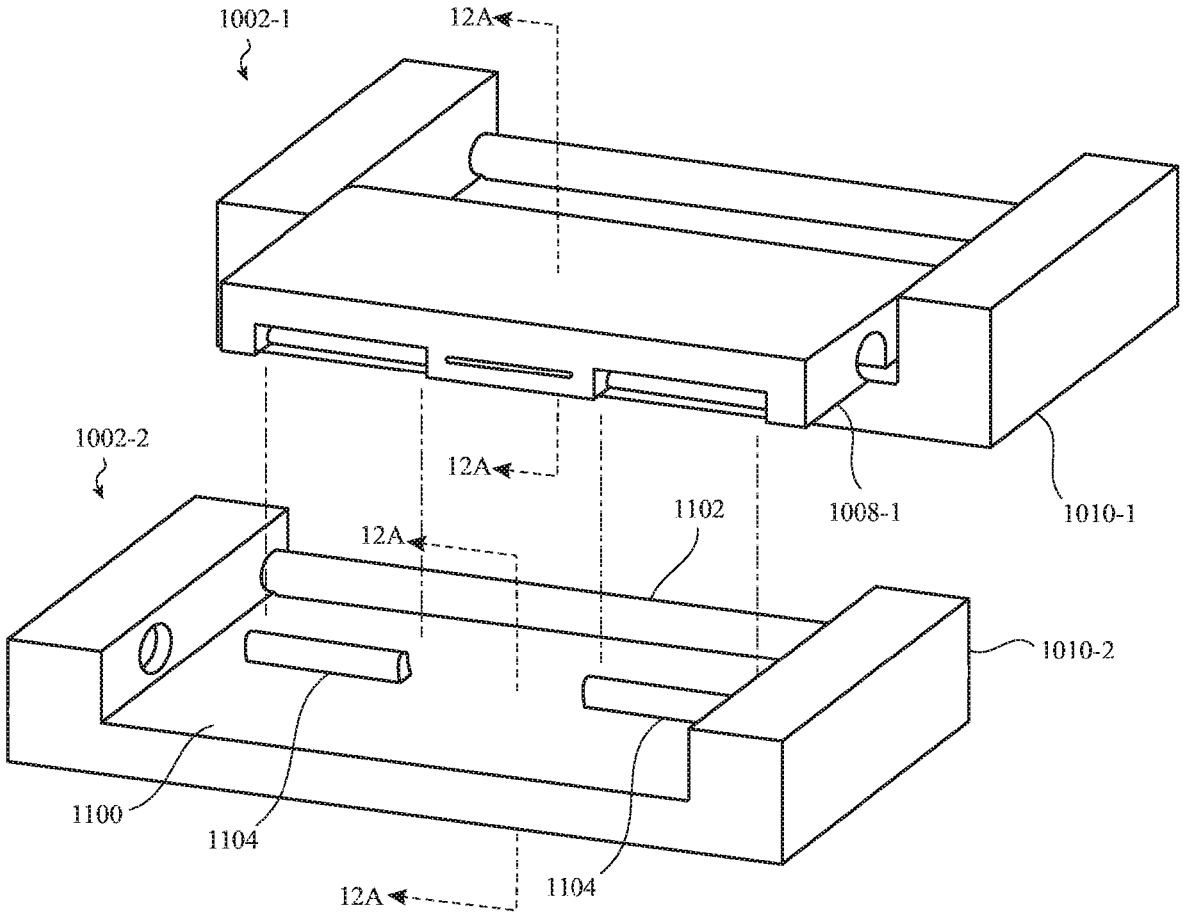
FIG. 11 depicts an illustrative perspective view of components of releasable link assemblies, in accordance with some embodiments.

FIG. 11 depicts an illustrative perspective view of a releasable link assembly 1002-1 (also referred to as a "releasable link 1002-1," or simply a "link 1002-1"), and a portion of a complimentary releasable link assembly 1002-2, showing the links 1002-1, 1002-2 in an open (e.g., unlatched) configuration.

A releasable link assembly 1002-1 includes a latching link 1008-1 and a receptacle link 1010-1 that is pivotally coupled to the latching link 1008-1. The latching link 1008-1 of the releasable link assembly 1002-1 is configured to releasably couple to a receptacle link 1010-2 of a complimentary releasable link assembly 1002-2.

The receptacle link 1010-2 includes a base surface 1100 and at least one channel that is defined on a first side by a first friction cam feature 1102 that extends away from the base surface 1100, and defined on a second side by a catch feature 1104 extending away from the base surface 1100. The channel is substantially perpendicular to the overall length of the band 1004, and is configured to receive and securely latch to one or more features of the latching link 1008-1, as described herein.

Figure 12A:
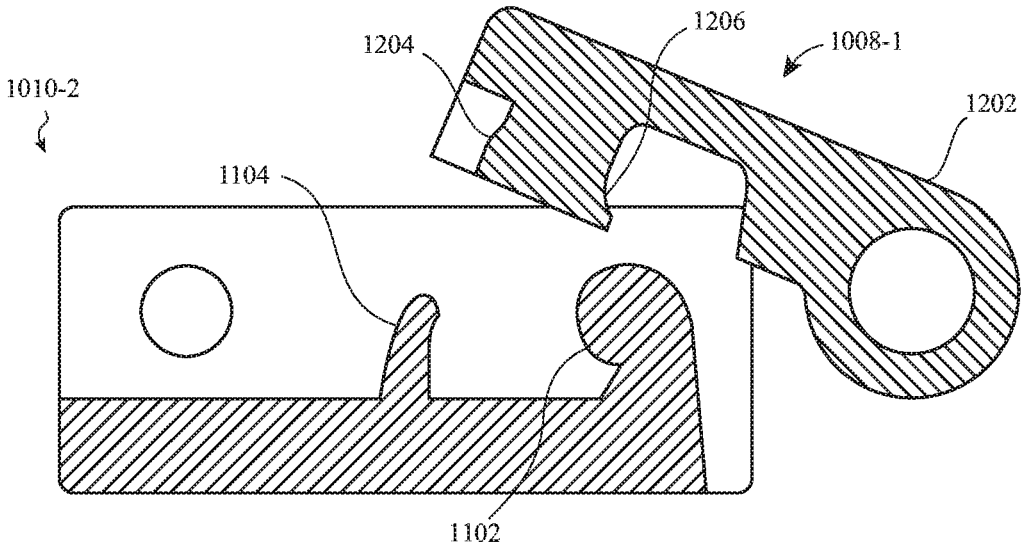
FIGS. 12A-12C depict illustrative cross-sectional views of components of releasable link assemblies, in accordance with some embodiments
Figure 12B:
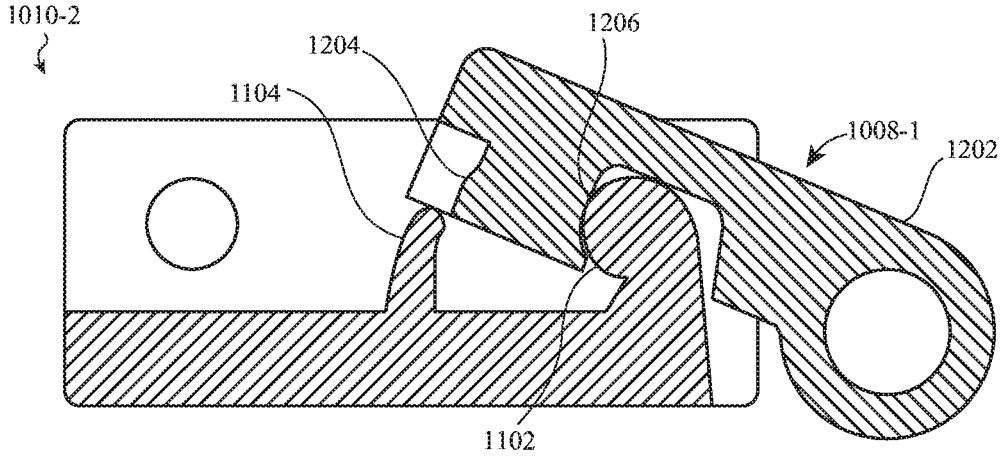
Figure 12C:
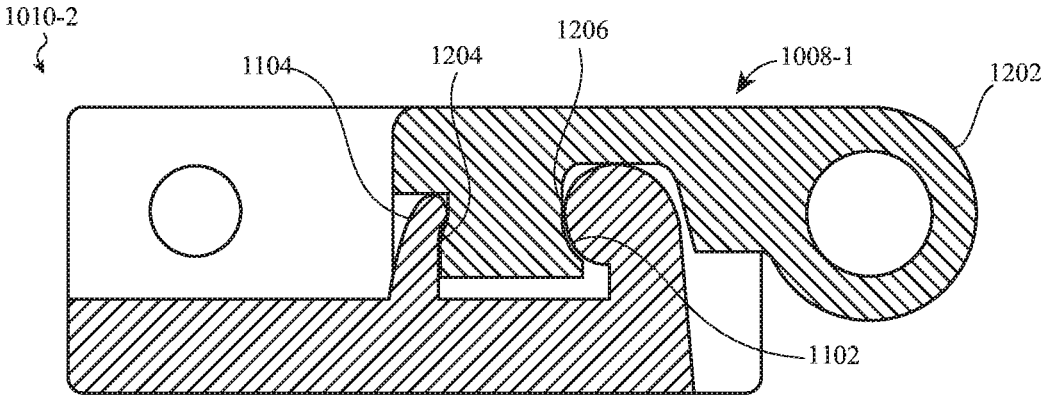

FIGS. 12A-12C are cross-sectional views of a latching link 1008-1 and a receptacle link 1010-2 in a fully separated, a partially open, and a fully closed configuration, respectively, taken through line 12A-12A.

Turning to FIG. 12A, the latching link 1008-1 includes a pivot lug portion 1202 at a first end of the latching link 1108-1. The pivot lug portion 1202 is configured to couple the latching link 1008-1 to the receptacle link 1010-1 via a pivot member (not shown). In some embodiments, the pivot member is a spring bar, similar to those that are used to couple watch bands to watch cases. In such a case, the spring bar may pass through an opening 1208 (e.g., a cylindrical channel) in the pivot lug 1202, and ends of the spring bar may be seated in pivot openings in the receptacle link 1010-1. Other structures or mechanisms to pivotally couple the latching link 1008-1 to the receptacle link 1010-1 may also be used.

The latching link 1008-1 also includes a catch protrusion 1204 at a second end of the latching link 1008-1, the second end of the latching link 1008-1 being opposite to the first end. The catch protrusion 1204 is configured to engage with the catch feature 1104 of the complementary receptacle link 1010-2 to retain the receptacle link 1010-2 to the latching link 1008-1, as shown in FIGS. 12B-12C.

The latching link 1008-1 also includes a second friction cam feature 1206. The second friction cam feature 1206 is complementary to the first friction cam feature 1102 of the receptacle link 1010-2, and is configured to slidably engage with the first friction cam feature 1102 during the process of coupling the latching link 1008-1 to (and decoupling the latching link 1008-1 from) the receptacle link 1010-2.

In some embodiments, as shown in FIGS. 11-12C, the catch protrusion 1204 and the second friction cam feature 1206 are formed as a unitary feature. More specifically, a single latching protrusion includes the catch protrusion 1204 on a first side, and the second friction cam feature 1206 on a second side opposite to the first side. In other embodiments, however, the catch protrusion 1204 and the second friction cam feature 1206 are formed as separate features, and are separated by a channel that is defined by the features themselves. In the latter case, the features that form the catch protrusion and the second friction feature may each be relatively smaller than a unitary structure that includes both features, making them relatively more flexible than a unitary structure may be. This may help reduce the force required to securely engage the catch protrusion with the catch feature of the receptacle link, as a more flexible catch protrusion may deflect more easily when sliding past the catch feature.

In order to removably couple the latching link 1008-1 to the receptacle link 1010-2, a user first orients the links such that the latching link 1008-1 is angled with respect to the receptacle link 1010-2 (i.e., such that the catch feature 1204 of the latching link 1008-1 is tilted above the channel in the receptacle link 1010-2, as shown in FIG. 12A), and places the second friction cam feature 1206 in contact with the first friction cam feature 1102, as shown in FIG. 12B. The user then rotates the latching link 1008-1 in a counterclockwise direction (based on the orientation of the components in the figure), such that the second friction cam feature 1206 slides over the first friction cam feature 1102, resulting in the catch protrusion 1204 being received within the channel and engaging with the catch feature 1104, as shown in FIG. 12C. Once the catch feature 1104 is engaged with the catch protrusion 1204, the latching link 1008-1 is removably coupled to the receptacle link 1010-2.

The rotation of the second friction cam feature 1206 over the first friction cam feature 1102 creates a secure coupling between the latching link 1008-1 and the receptacle link 1010-2, because both the second friction cam feature 1206 and the catch protrusion 1204 are disposed within and retained by the channel defined by the first friction cam feature 1102 and the catch feature 1104. In particular, the second friction cam feature 1206 is contoured such that, when the links are coupled, a portion of the second cam feature 1206 is disposed underneath a protruding portion of the first cam feature 1102. Thus, the protruding portion of the first cam feature 1102 acts as an undercut that engages with and retains the protruding portion of the second friction cam feature 1206 within the channel, thus preventing the latching link 1108-1 from being decoupled from the receptacle link 1010-2. As is shown in FIG. 12C, a similar engagement exists between the catch feature 1104 and the catch protrusion 1204, which furthers the engagement between the latching and receptacle links.

Moreover, the counterclockwise rotation that is used to removably couple the latching link 1008-1 to the receptacle link 1010-2 also ensures that the articulation of the releasable link assembly caused by a user wrapping the band over a wrist tends to further secure, rather than separate, the link assemblies. More specifically, when the band is wrapped around a user's wrist, each latching link 1008-1 is subjected to a counterclockwise articulation with respect to a complementary receptacle link 1010-2, thus biasing the latching link 1008-1 toward a secure, latched position. On the other hand, the latching link 1008-1 would only be removable from the receptacle link (absent extreme, possibly damaging force) by rotating the latching link 1008-1 in a clockwise direction with respect to the receptacle link 1010-2, and such a motion would be difficult to achieve when the band is secured to a user's wrist or body.

Clasps

Figure 13A:
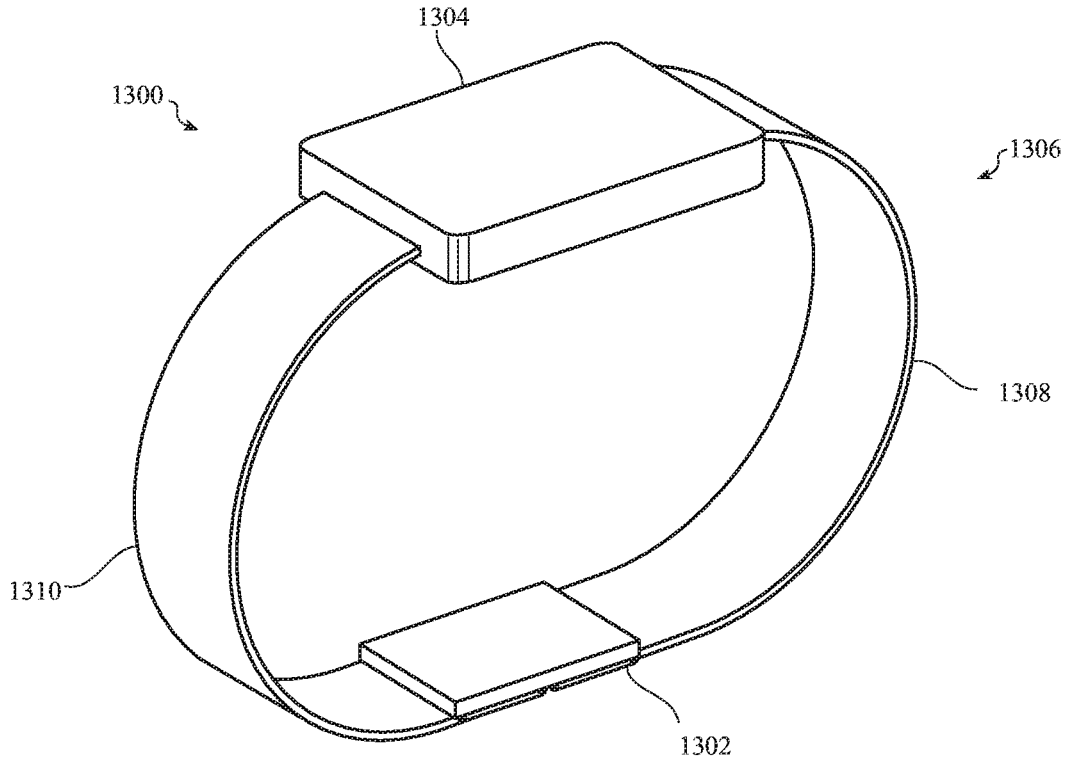
FIG. 13A depicts an illustrative perspective view of one example of a wearable electronic device, in accordance with some embodiments.

As noted above, bands for watches and other wearable devices, whether they include releasable link assemblies or not, frequently have clasps that allow the user to open and close the band to facilitate application and removal of the device from the user's wrist. FIG. 13A is an illustrative perspective view of one example of a wearable device 1300

(also referred to as "device 1300") that includes a clasp 1302 in accordance with some embodiments. As described herein, the clasp 1302 may be used in conjunction with a band that has a plurality of releasable link assemblies. In some cases, however, the clasp 1302 may be used in conjunction with bands that do not include such assemblies.

Returning to FIG. 13A, the device 1300 may include a housing 1304. The housing 1304 may include mounting features formed on opposite ends to connect a wearable band 1306 (also referred to as "band 1306") to the housing 1304. As shown in FIG. 13A, and discussed herein, the band 1306 may include a first strap 1308 and a second strap 1310 positioned opposite the first strap 1308. In some embodiments, either or both the first and the second straps 1308, 1310 include one or more releasable link assemblies, such as those described above. In some embodiments, the first and second straps 1308, 1310 are composed entirely of releasable link assemblies.

The band 1306 may also include a clasp 1302 coupled to the first strap 1308 and the second strap 1310. The band 1306, and specifically first strap 1308, the second strap 1310, and the clasp 1302, may be used to secure the device 1300 to a user, or to any other object capable of receiving the device 1300.

Figure 13B:
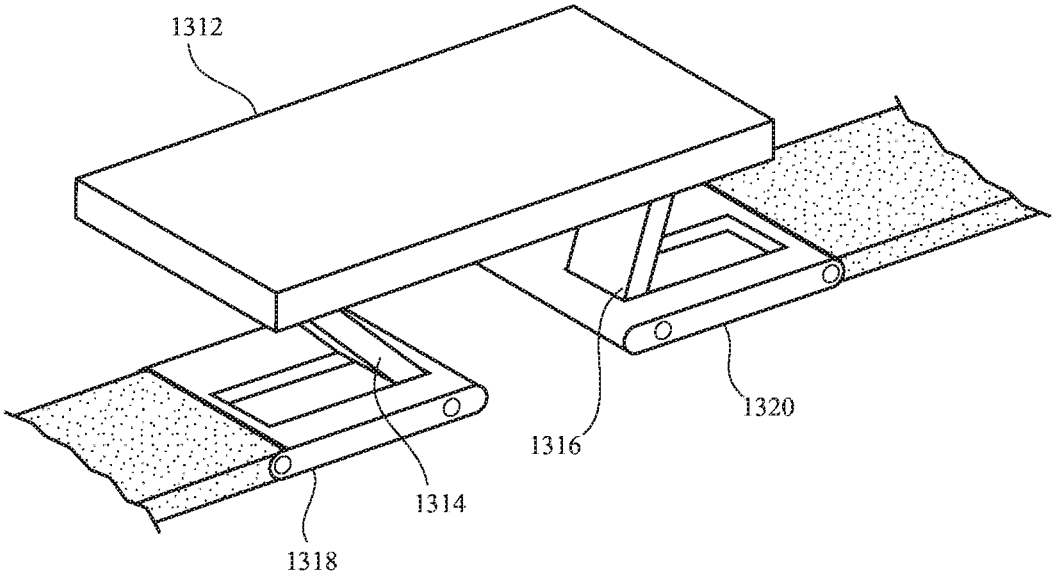
FIG. 13B depicts an illustrative perspective view of one example of a clasp for a wearable electronic device, in accordance with some embodiments.

FIG. 13B illustrates a perspective view of the clasp 1302, showing the clasp 1302 in a partially open configuration. In this example, the clasp 1302 includes a clasp body 1312 pivotally coupled to first and second connecting arms 1314, 1316. The connecting arms 1314, 1316 are, in turn, pivotally coupled to respective clasp covers 1318, 1320. The operation of the pivoting couplings between the connecting arms and the clasp body and respective clasp covers allows the clasp 1302 to articulate between an open configuration and a closed configuration. In the closed configuration, the connecting arms 1314, 1316 are disposed at least partially between the clasp body 1312 and the clasp covers 1314, 1316 such that the clasp covers may engage with the clasp body via a latching mechanism (not shown) to secure the clasp in a closed configuration.

Figure 14A:
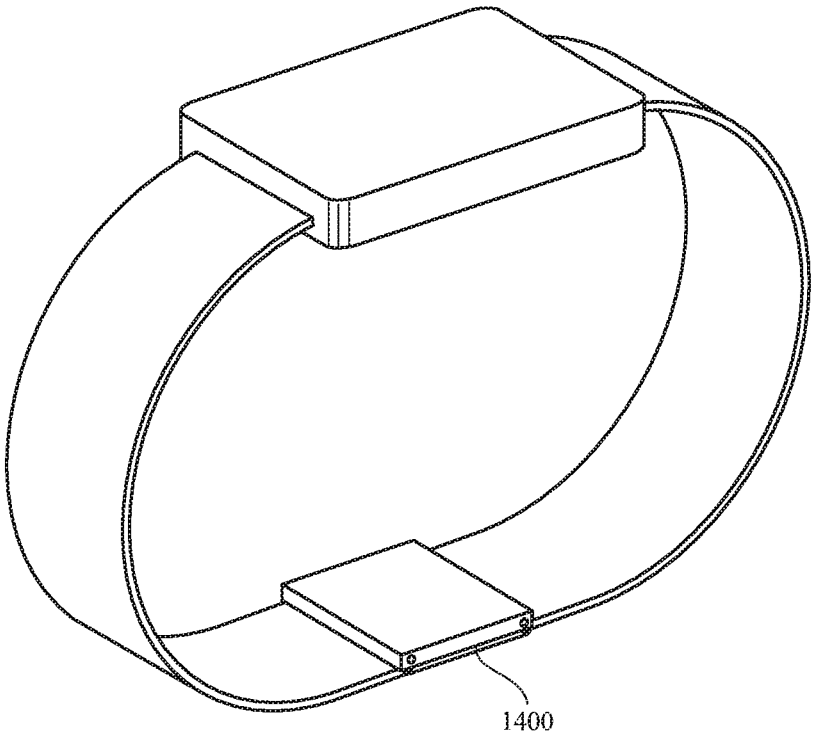
FIG. 14A depicts an illustrative perspective view of one example of a wearable electronic device, in accordance with some embodiments.
Figure 14B:
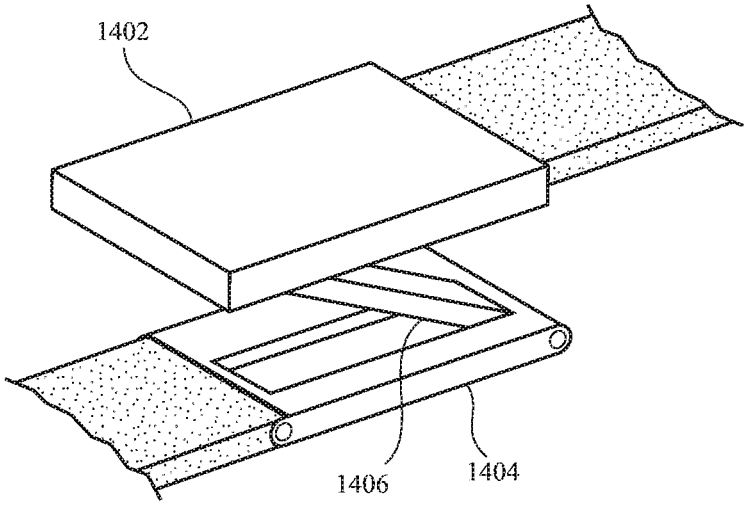
FIG. 14B depicts an illustrative perspective view of one example of a clasp for a wearable electronic device, in accordance with some embodiments.

While FIGS. 13A-13B illustrate a clasp 1302 that has two connecting arms and two clasp covers, a clasp 1400 (having a clasp body 1402) in accordance with the embodiments described herein may include only one connecting arm 1406 and only one clasp cover 1404, as shown in FIGS. 14A-14B. It will be understood that the descriptions of the various spring and biasing mechanisms described herein apply equally to either type of clasp.

Also, while components of the clasps are referred to by certain names in the present description, it will be understood that these names are merely for convenience, and that other names or terminology may also be appropriate. For example, in some embodiments, a clasp cover need not actually cover all (or even a portion of the clasp). Indeed, it will be apparent to one of ordinary skill in the art that the following descriptions may relate to any clasp or linkage having components that are pivotally coupled to one another.

As noted above with respect to the releasable link assemblies, including biasing springs in a clasp to cause the clasp to forcibly separate (or "pop" open) may increase the functionality and usability of a clasp. For example, when a user unlatches or unsnaps a clasp that includes biasing mechanisms as described herein, the clasp may at least partially separate under its own force, thus allowing the user to more easily open the clasp, and obviating the need to apply complex manipulations to the clasp to both unlatch the clasp and unfold the mechanism. Moreover, clasps may be retained in a closed configuration by operation of hook-shaped latches or catches, and a force that biases the latch toward an open configuration may help to force the hook of the latch against a retaining structure, thereby increasing the strength and the security of the clasp. Various example embodiments of mechanisms and assemblies for imparting a biasing force between components of the clasp are shown and described with respect to FIGS. 15A-21C.

Figure 15A:
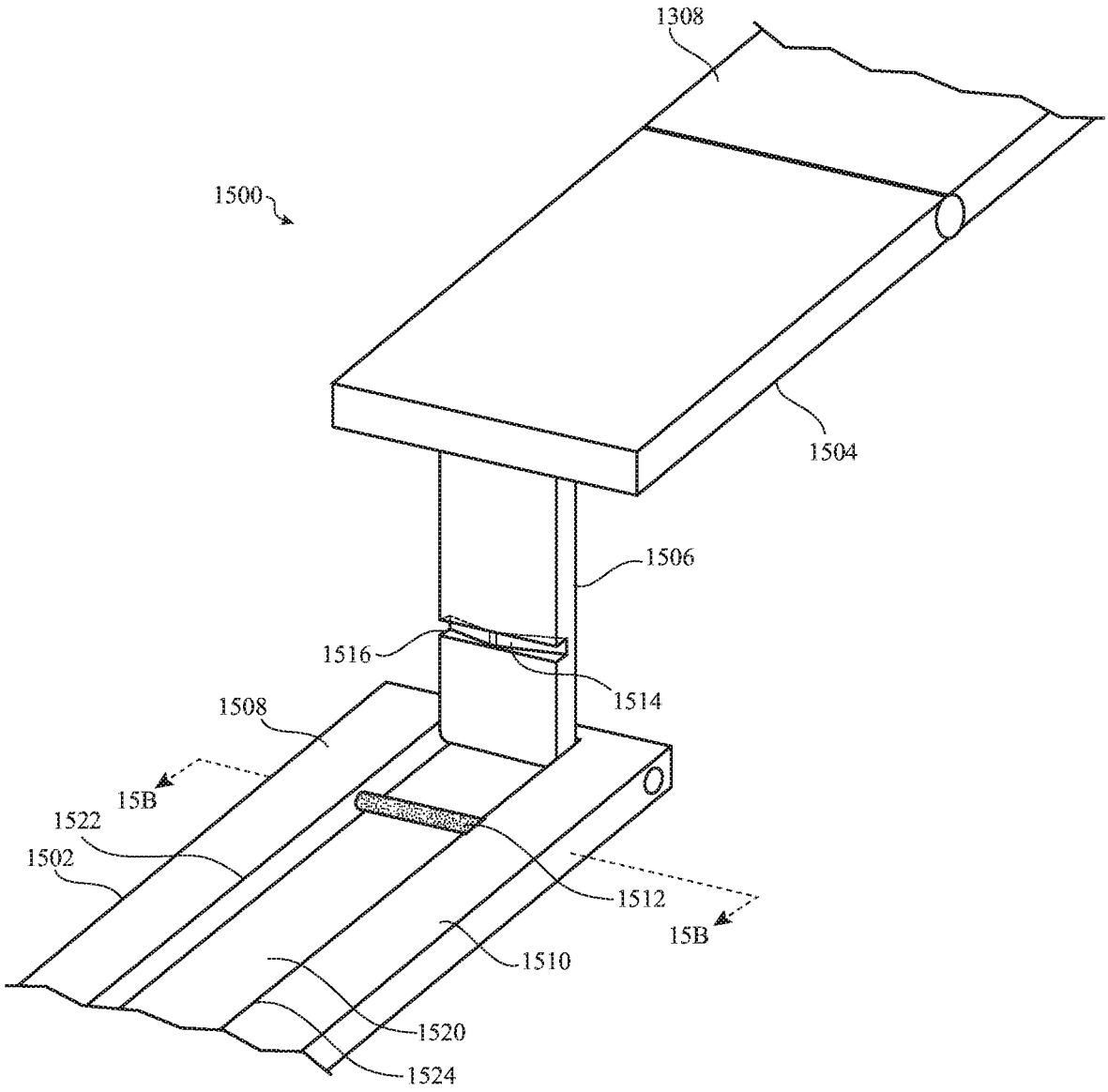
FIGS. 15A-15B depict illustrative perspective and cross-sectional views, respectively, of a clasp for a wearable electronic device, in accordance with some embodiments.

FIG. 15A is an illustrative perspective view of a clasp 1500, in accordance with some embodiments, showing the clasp 1500 in a partially open configuration. The clasp includes a clasp body 1502, a clasp cover 1504, and a connecting arm 1506 that is pivotally coupled to the clasp body 1502 at a first end of the connecting arm 1506, and pivotally coupled to the clasp cover 1504 at a second end of the connecting arm 1506. The clasp 1500 is movable between an open configuration and a closed configuration, where, in the closed configuration, the clasp body 1502 is retained with the clasp cover 1504, and the connecting arm 1506 is disposed between the clasp body 1502 and the clasp cover 1504.

Figure 15B:
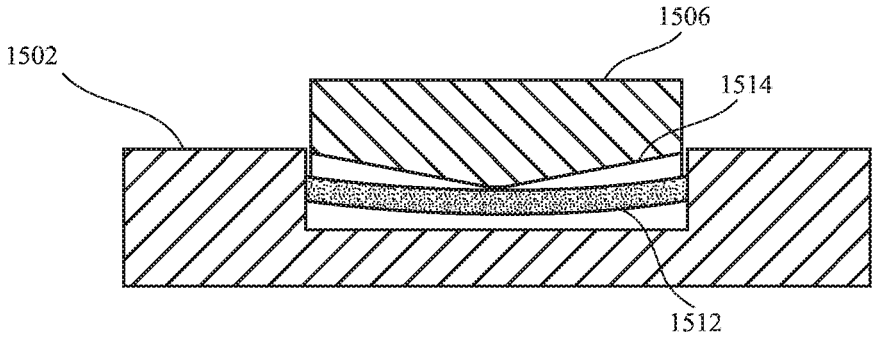

The clasp body 1502 includes a first elongate member 1508 and a second elongate member 1510 defining first and second sides, respectively, of a channel 1520 between the elongate members. In some embodiments, the channel 1520 is open at the bottom, whereas in other embodiments, it is enclosed at the bottom (e.g., the channel 1520 includes a bottom surface). As shown in FIGS. 15A-15B, the channel is enclosed at the bottom.

The clasp body 1502 includes a spring member 1512 extending across the channel 1520 from a first wall 1522 of the channel 1520 to a second wall 1524 of the channel 1520. The spring member 1512 may be any appropriate material, such as steel, titanium, metal alloy, polymer, or any other appropriate material. The spring member 1512 may be of any appropriate shape or configuration. For example, the spring member 1512 may be a wire spring having a substantially circular cross section. As another example, the spring member may be a leaf spring having a substantially rectangular cross section. Other shapes may also be used for the spring member 1512.

The connecting arm 1506 engages with the spring member 1512 when the clasp 1500 is in the closed configuration to impart a biasing force between the clasp body and the connecting arm (e.g., a force that biases the clasp toward an open and/or unlatched configuration). In particular, when the clasp 1500 is closed, the connecting arm 1506 is at least partially disposed within the channel, which causes the connecting arm 1506 to contact and deform the spring member 1512. The deformation of the spring member, in turn, provides a force in the opposite direction (e.g., the biasing force), thus biasing the connecting arm 1506 away from the clasp body 1502. As noted above, when the clasp 1500 is secured in the closed configuration, this biasing force may increase the security of the clasp, and when the clasp 1500 is unlatched by a user, the biasing force will forcibly separate the connecting arm 1506 and the clasp body 1502, resulting in the clasp "popping" open for easier removal or application.

In some embodiments, the connecting arm 1506 includes a protrusion 1514 that is configured to engage with (and deform) the spring member when the clasp 1500 is in the closed configuration. For example, as shown in FIG. 15B, the connecting arm 1506 includes a triangular protrusion 1514 that extends transversely across the connecting arm from a first side of the to a second side. In particular, the triangular protrusion begins at the first side of the connecting arm, increasing its height away from the connecting arm until it reaches the middle of the connecting arm 1506, and then decreases in height toward the second side of the connecting arm 1506.

The triangular protrusion 1514 is positioned such that the peak of the protrusion contacts the spring member 1512 at a point between the ends of the spring member (e.g., at the middle of the spring member 1512). The triangular protrusion 1514 may improve the durability and effectiveness of the spring member 1512, because the deformation force can be focused at a point that is further away from the joint between the spring member 1512 and the walls 1522, 1524 of the channel. More specifically, by contacting the middle portion of the spring member 1512, the triangular protrusion 1514 can reduce the shear forces that might otherwise be imparted to the spring member 1512 if the connecting arm contacted the spring member 1512 proximate to the walls of the channel.

In some embodiments, the protrusion (e.g., the triangular protrusion 1514) is disposed at least partially within a groove 1516 in the connecting arm 1506 that extends transversely across the connecting arm from the first side to the second side of the connecting arm. In such cases, portions of the spring member 1512 may be disposed at least partially within the groove 1516 when the clasp is in the closed configuration. In some embodiments, however, the protrusion is not set inside any groove or channel, and it simply extends away from a surface of the connecting arm.

FIG. 15B is an illustrative cross-sectional view of the connecting arm 1506 and the clasp body 1502, taken through line 15B-15B in FIG. 15A. FIG. 15B illustrates the clasp 1500 in the closed configuration, such that the triangular protrusion 1514 has contacted the spring member 1512 and deformed it. The deformed spring member 1512 is, therefore, imparting a biasing force between the connecting arm 1506 and the clasp body 1502.

Figure 15C:
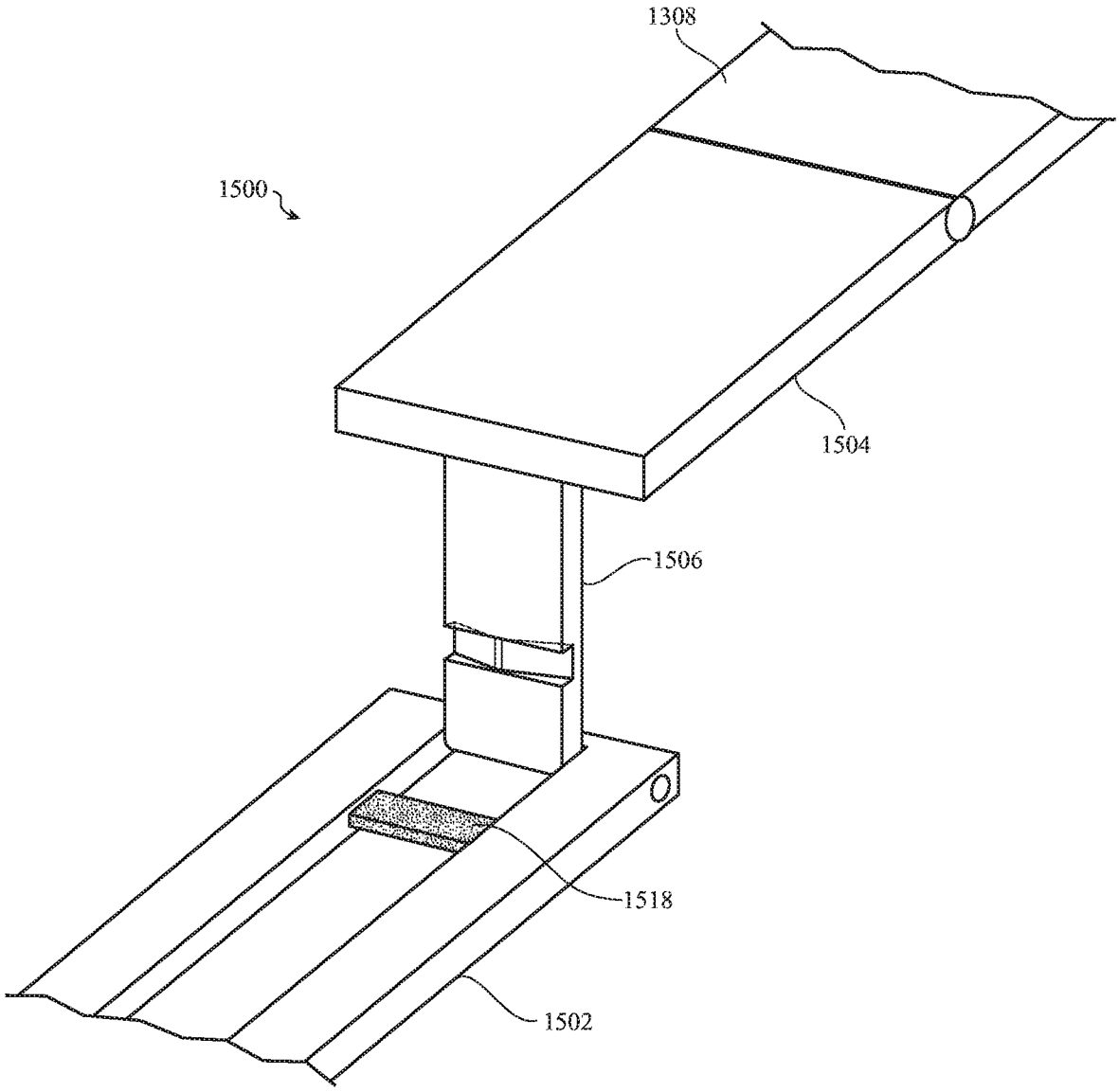
FIG. 15C depicts an illustrative perspective view of a clasp for a wearable electronic device, in accordance with some embodiments.

FIG. 15C is an illustrative perspective view of a clasp 1500, in accordance with some embodiments, showing the clasp 1500 in a partially open configuration. In this embodiment, the spring member 1518 is a leaf spring, rather than the wire spring member 1512 shown in FIG. 15A.

In the embodiments described above with respect to FIGS. 15A-15B, the mechanisms have been shown and described as imparting a biasing force between the clasp body 1502 and the connecting arm 1506. In some embodiments, the mechanisms are configured such that the biasing force is imparted between the connecting arm 1506 and the clasp cover 1504. In such cases, the components, features, and/or mechanisms that are described herein as being coupled to or otherwise part of the clasp body 1502 may instead or additionally be located on the clasp cover 1504. For example, a spring member 1512 such as that shown in FIG. 15A may be located on the clasp cover 1504 instead of the clasp body 1502, and the protrusion 1514 on the connecting arm 1506 may be located on the opposite face of the connecting arm 1506, such that the protrusion 1514 engages with the spring member that is coupled to the clasp cover 1504. Moreover, in some embodiments, multiple spring mechanisms are provided so that biasing forces are imparted between the connecting arm 1506 and both the clasp body 1502 and the clasp cover 1504.

FIG. 16 is an illustrative perspective view of a clasp 1600, in accordance with some embodiments, showing the clasp 1600 in a partially open configuration. The clasp includes a clasp body 1602, a clasp cover 1604, and a connecting arm 1606 that is pivotally coupled to the clasp body 1602 at a first end of the connecting arm 1606, and pivotally coupled to the clasp cover 1604 at a second end of the connecting arm 1606. The clasp 1600 is movable between an open configuration and a closed configuration, where, in the closed configuration, the clasp body 1602 is retained with the clasp cover 1604, and the connecting arm is disposed between the clasp body 1602 and the clasp cover 1604.

The connecting arm 1606 includes a spring member 1608 coupled thereto, where the spring member 1608 extends transversely across the connecting arm 1606 from a first side to a second side. The spring member 1608 is configured to engage with the clasp body 1602 when the clasp 1600 is in the closed configuration, such that the spring member 1608 is deformed, thereby imparting a biasing force between the clasp body 1602 and the connecting arm 1606. In some embodiments, the spring member 1608 (and the fulcrum 1610, discussed below) are contained at least partially within a groove 1612 in the connecting arm 1606.

In some embodiments, the clasp body 1602 includes one or more protrusions 1614 that are configured to engage with the spring member 1608. In particular, in some embodiments, protrusions 1614 are located within a channel in the clasp body 1602 such that they contact the ends of the spring member 1608, as shown in FIG. 16B.

Figure 16A:
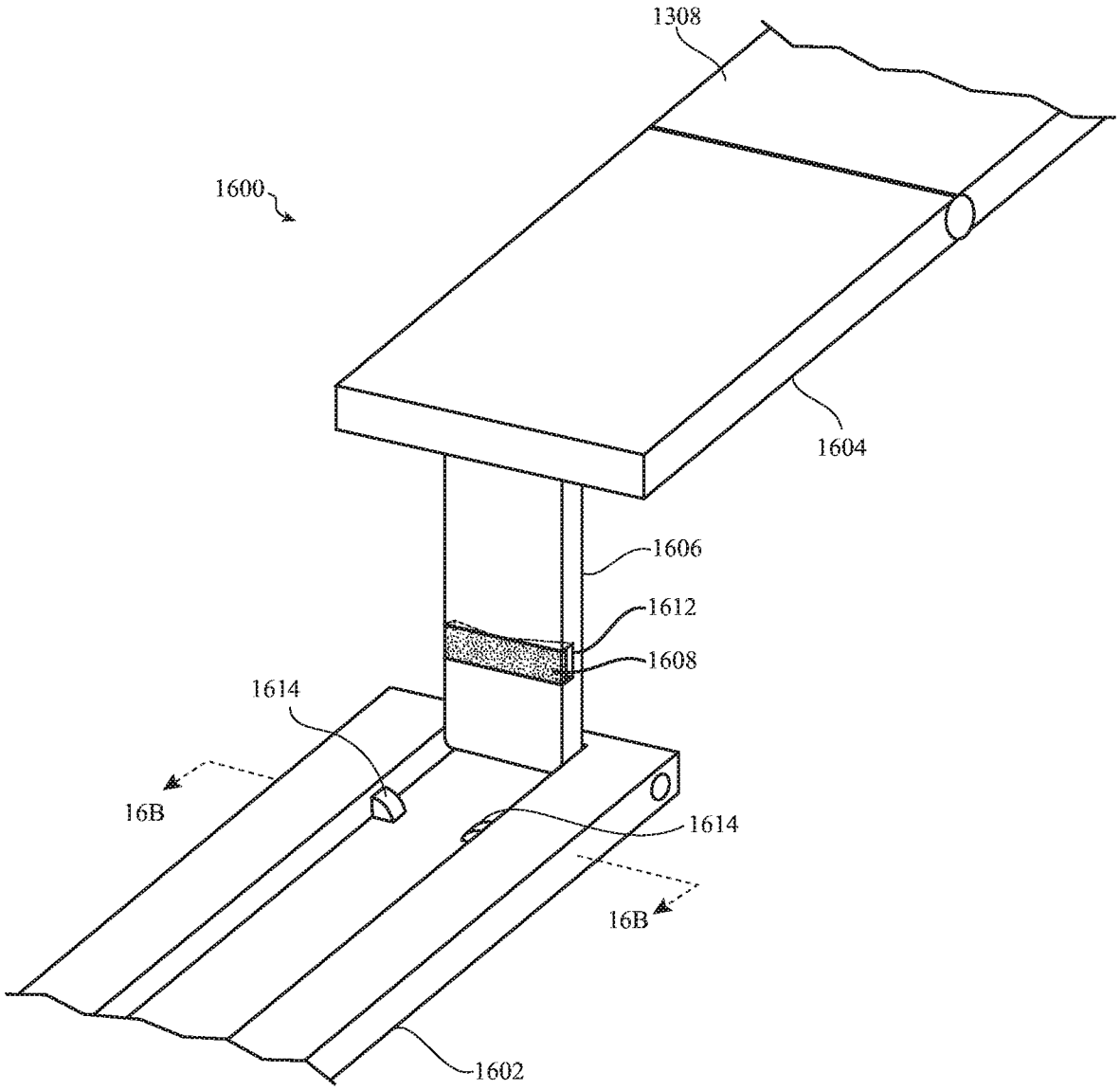
FIGS. 16A-16B depict illustrative perspective and cross-sectional views, respectively, of a clasp for a wearable electronic device, in accordance with some embodiments.
Figure 16B:
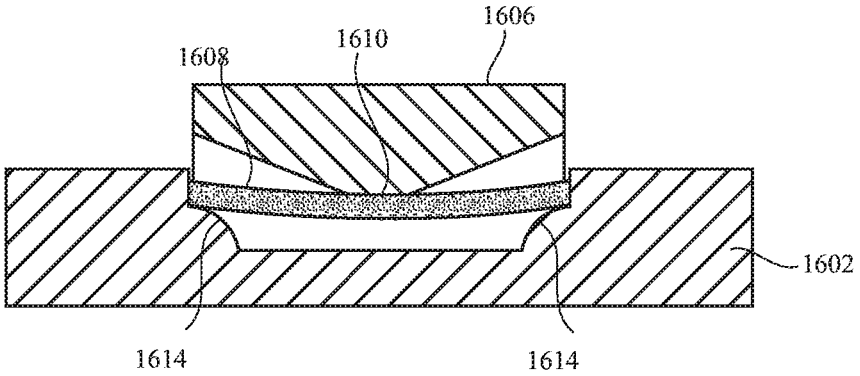

FIG. 16B is an illustrative cross-sectional view of the connecting arm, taken through line 16B-16B. The connecting arm 1606 includes a groove in a surface of the connecting arm 1606, where the groove includes a fulcrum 1612. The spring member 1608 is mounted or coupled to the fulcrum 1610 at or near the mid-point of the spring member 1608. This configuration allows the spring member 1608 to bend about the fulcrum 1610 when the clasp 1600 is in the closed configuration. FIG. 16B also illustrates how the protrusions 1614 engage with the ends of the spring member 1608 to bend the spring member 1608 about the fulcrum 1610.

Figure 17A:
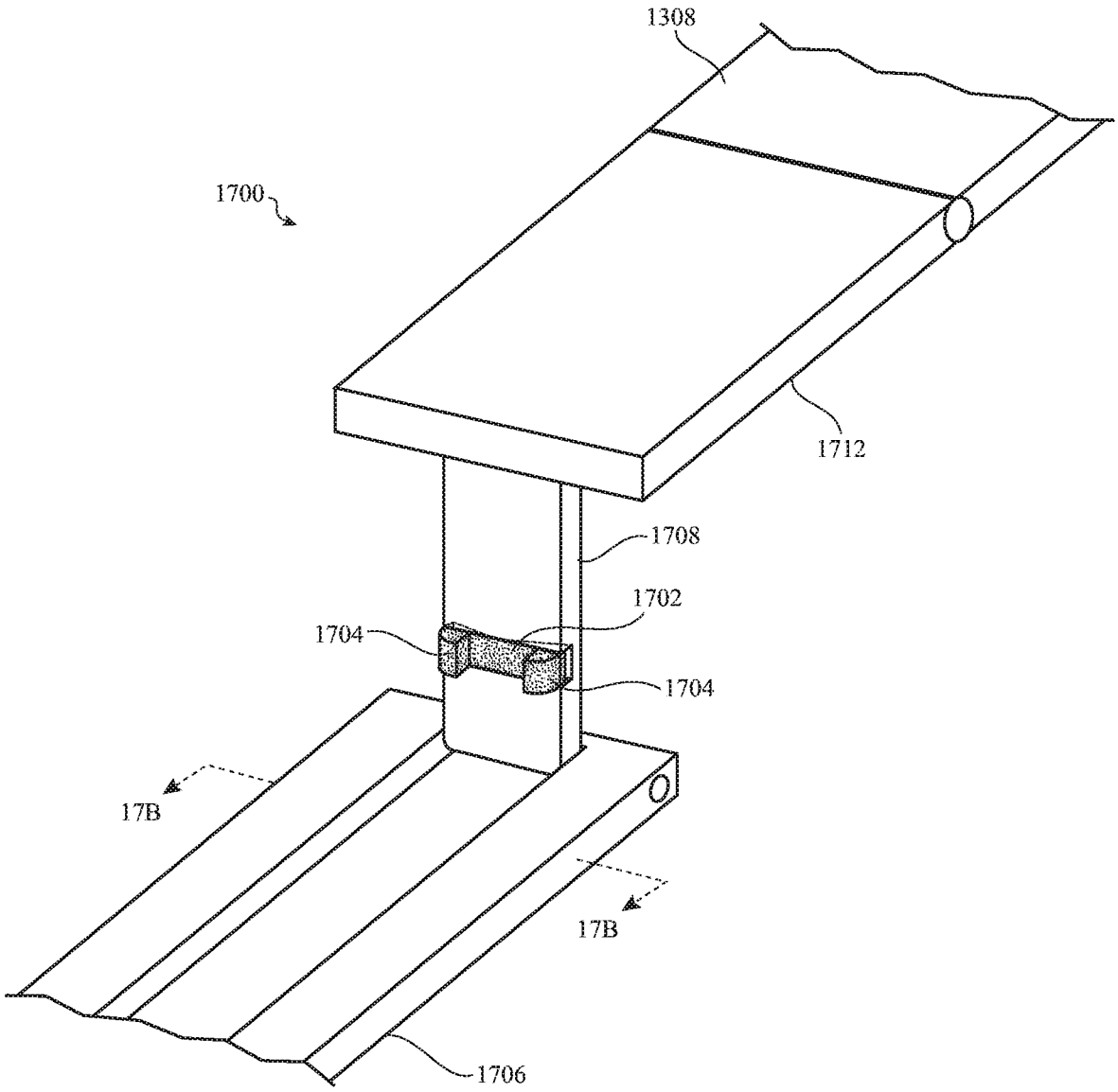
FIGS. 17A-17B depict illustrative perspective and cross-sectional views, respectively, of a clasp for a wearable electronic device, in accordance with some embodiments.
Figure 17B:
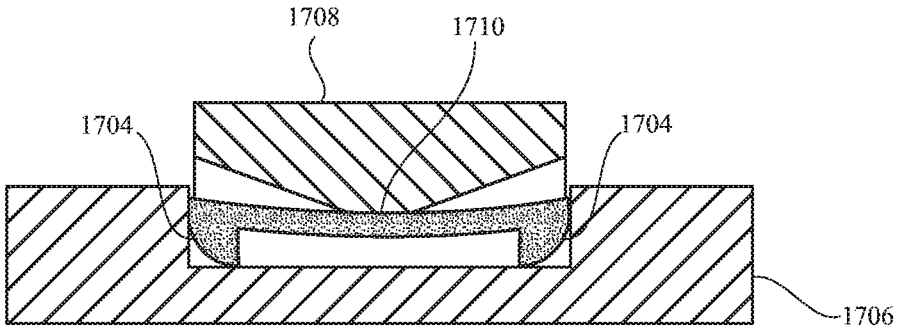

FIGS. 17A-17B are illustrative perspective and cross sectional views, respectively, of a clasp 1700. The clasp 1700 includes a clasp body 1706, a clasp cover 1712, and a connecting arm 1708 that is pivotally coupled to the clasp body 1706 at a first end of the connecting arm 1708, and pivotally coupled to the clasp cover 1712 at a second end of the connecting arm 1708. The clasp 1700 is movable between an open configuration and a closed configuration, where, in the closed configuration, the clasp body 1706 is retained with the clasp cover 1712, and the connecting arm 1708 is disposed between the clasp body 1706 and the clasp cover 1712.

The clasp 1700 is similar to the clasp 1600 described with respect to FIGS. 16A-16B, except that protrusions 1704 are located on the spring member 1702, rather than in the channel of the clasp body 1706. Thus, as shown in FIG. 17B, the interaction between the protrusions 1704 and the clasp body 1706 causes the spring member 1702 to bend about the fulcrum 1710. In this embodiment, though the spring member 1702 may be disposed within the groove of the connecting arm 1708 when the spring is not deformed, the protrusions 1704 may extend outside of the groove, beyond the surface of the connecting arm 1708. Thus, the protrusions 1704 will contact the clasp body 1706 when the clasp is in the closed configuration.

FIG. 18 is an illustrative perspective view of a clasp 1800, in accordance with some embodiments, showing the clasp 1800 in a partially open configuration. The clasp includes a clasp body 1802, a clasp cover 1804, and a connecting arm 1806 that is pivotally coupled to the clasp body 1802 at a first end of the connecting arm 1806, and pivotally coupled to the clasp cover 1804 at a second end of the connecting arm 1806. The clasp 1800 is movable between an open configuration and a closed configuration, where, in the closed configuration, the clasp body 1802 is retained with the clasp cover 1804, and the connecting arm 1806 is disposed between the clasp body 1802 and the clasp cover 1804.

Figure 18A:
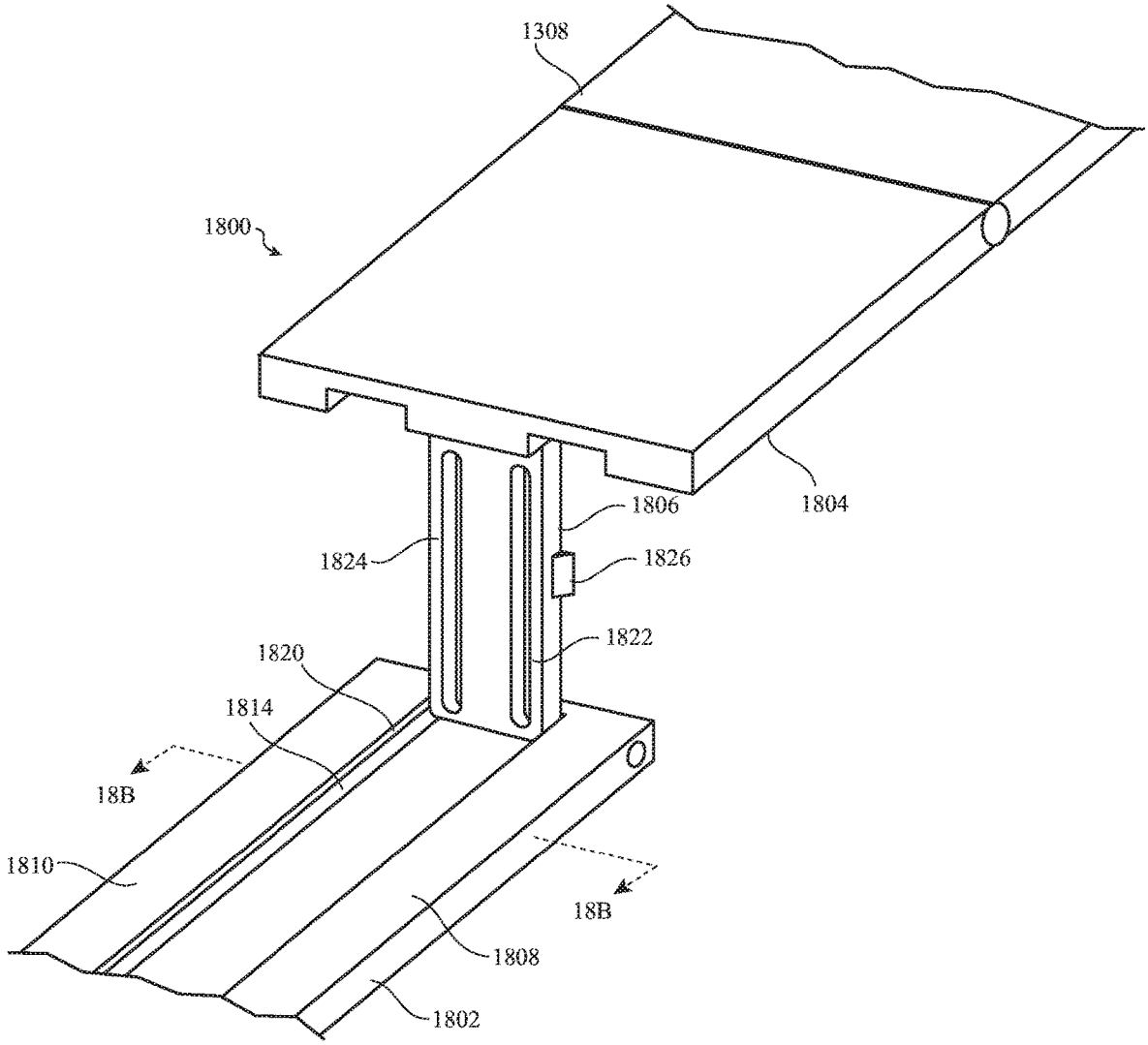
FIG. 18A depicts an illustrative perspective view of a clasp for a wearable electronic device, in accordance with some embodiments.
Figure 18B:
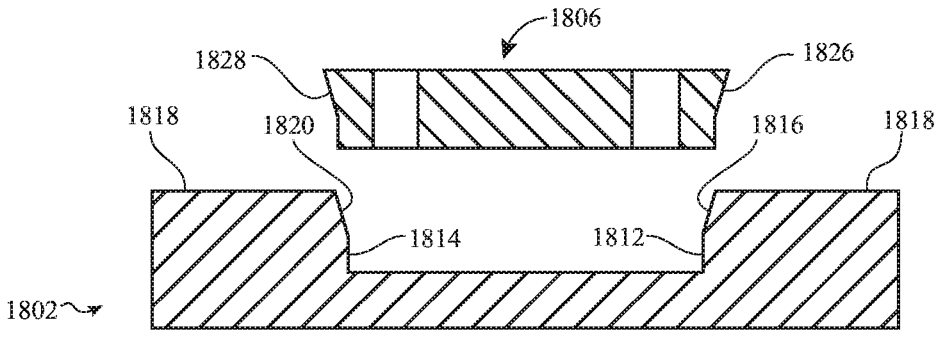
FIGS. 18B-18C depict illustrative cross-sectional views of the clasp of FIG. 18A, in accordance with some embodiments.

The clasp body 1802 includes first and second elongate members 1808, 1810 defining a first wall 1812 (FIG. 18B) and a second wall 1814 of a channel between the elongate members. The clasp body 1802 also includes a first chamfer 1816 between the first wall 1814 and a first surface 1818 of the clasp body (e.g., a surface of the clasp body that faces the clasp cover) (FIG. 18B). The clasp body 1802 includes a second chamfer 1820 between the second wall 1812 and the first surface 1818 (FIGS. 18A, 18B).

The connecting arm 1806 includes at least a first compliant member 1824, and a second compliant member 1822. In some embodiments, the compliant members 1824, 1822 are defined by openings formed in the connecting arm. In some embodiments, the connecting arm 1806 and the complaint spans 1824, 1822 are a monolithic component. In such cases, the openings may be formed in any appropriate way, including machining, casting, or the like. In other embodiments (not shown), the compliant spans are distinct components that are coupled to the connecting arm 1806.

The compliant members each include a respective wedge 1826, 1828 that is configured to engage with a respective chamfer 1816, 1820 of the clasp body 1802. In particular, with reference to FIG. 18B, the wedge 1826 is configured to contact the first chamfer 1816 of the clasp body 1802, such that the compliant member 1822 forces the wedge 1826 against the chamfer 1816. The force imparted by the complaint member 1822 is substantially perpendicular to the first wall 1812 of the channel. Because the contact surfaces of the chamfer 1816 and wedge 1826 are not perpendicular to the force imparted by the compliant member 1822, however, a biasing force is generated between the connecting arm 1806 and the clasp body 1802. In particular, the angled contact surfaces of the wedge 1826 and the chamfer 1816 cause a portion of the force imparted by the compliant member 1822 to be transformed into a force that is parallel with the first wall 1812 (e.g., a biasing force).

In some embodiments, the materials and surface finishes/treatments/polishes of the wedges and chamfers are selected so as to result in a desired coefficient of friction between the wedges and chamfers, and thus provide a desired biasing force. For example, if the coefficient of friction is too high, the biasing force may not be sufficient to overcome the coefficient of friction, and the biasing force will not cause the connecting arm to be forcibly separated from the clasp body. Rather, the wedge and chamfer will simply remain in contact, and the user will have to pry the clasp open manually. On the other hand, if the coefficient of friction is properly selected, the biasing force will overcome the frictional forces between the wedges and chamfers, thus creating the desired effect.

While the foregoing example includes chamfers on the clasp body and compliant members (and wedges) on the connecting arm, one of ordinary skill in the art will recognize that these components may be swapped in some embodiments. For example, the clasp body 1802 may include compliant spans with wedges, and the connecting arm 1806 may include chamfers that engage with the wedges.

Figure 18C:
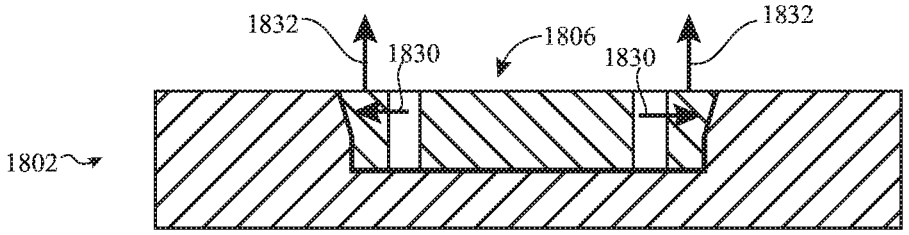

FIGS. 18B-18C are illustrative cross-sectional views of the connecting arm 1806 and a portion of the clasp body 1802, taken through line 18B-18B in FIG. 18A. FIG. 18B illustrates the clasp 1800 in an open configuration, where the clasp body 1802 is not engaged with the connecting arm 1806. FIG. 18C illustrates the clasp 1800 in a closed configuration, where the clasp body 1802 is engaged with the connecting arm 1806 such that the first and second wedges 1826, 1828 are in contact with the first and second chamfers 1816, 1820 of the clasp body 1802. Arrows 1830 indicate the force imparted by the compliant members on the wedges, and arrows 1832 indicate the resulting biasing force that is imparted between the clasp body 1802 and the connecting arm 1806.

Figure 19A:
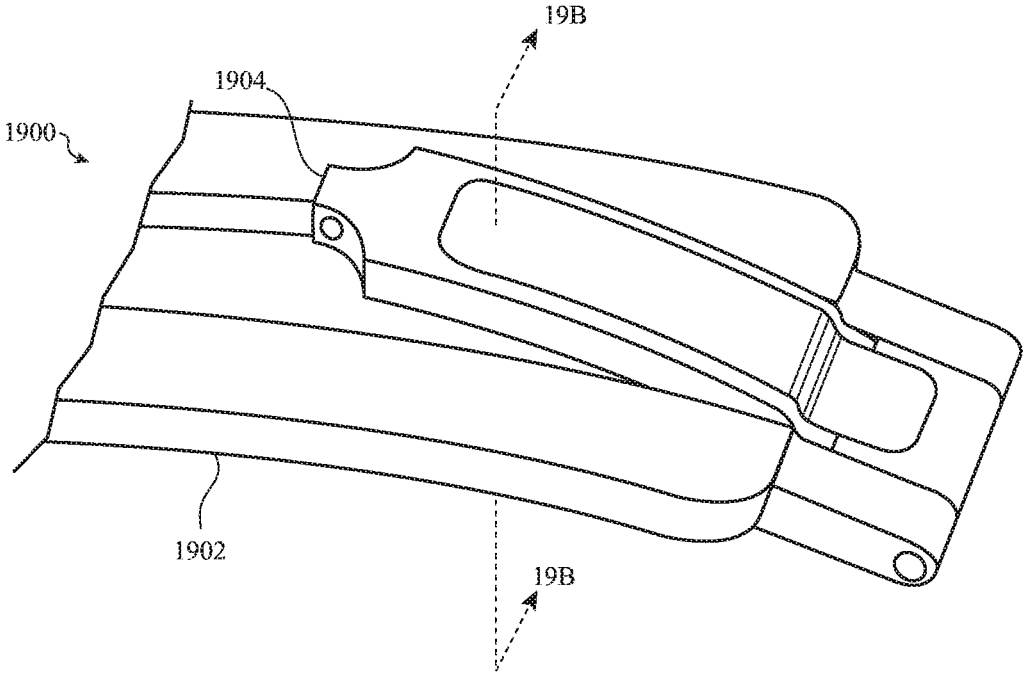
FIG. 19A depicts an illustrative perspective view of a clasp for a wearable electronic device, in accordance with some embodiments.

FIG. 19A is an illustrative perspective view of a clasp 1900, in accordance with some embodiments, showing the clasp 1900 in a partially open configuration. The clasp 1900 includes a clasp body 1902, a clasp cover (not shown), and a connecting arm assembly 1904 that is pivotally coupled to the clasp body 1902 at a first end of the connecting arm assembly 1904, and pivotally coupled to the clasp cover at a second end of the connecting arm assembly 1904 (similar to the coupling between the connecting arm 1708 and clasp cover 1704 in FIG. 17A). The clasp 1900 is movable between an open configuration and a closed configuration, where, in the closed configuration, the clasp body 1902 is retained with the clasp cover, and the connecting arm assembly is disposed between the clasp body 1902 and the clasp cover.

Figure 19B:
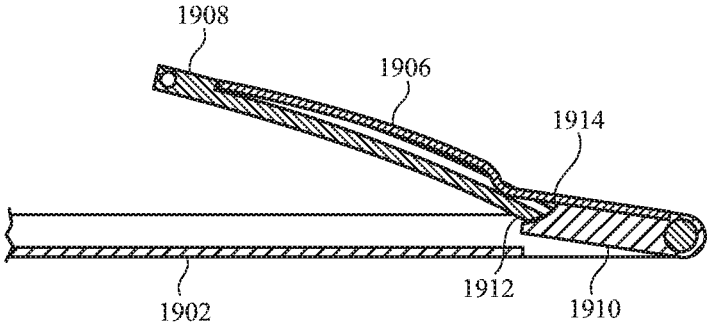
FIGS. 19B-19C depict illustrative cross-sectional views of the clasp of FIG. 19A, in accordance with some embodiments.

With reference to FIG. 19B, the connecting arm assembly 1904 includes a compliant member 1906, a first pivot lug member 1908 coupled to a first end of the compliant member 1904, and a second pivot lug member 1910 coupled to a second end of the compliant member 1904. The first and second pivot lug members are separate components, and are coupled to one another by the compliant member 1906. In some embodiments, the first and second pivot lug members contact one another at a location between the ends of the complaint member 1904. For example, as shown in FIG. 19B, the first pivot lug member 1908 extends along the length of the compliant member 1904 for more than half of the length of the complaint member 1904, and contacts the second pivot lug member 1910 near the opposite end of the compliant member 1904.

In some embodiments, a sliding end 1912 of the first pivot lug member 1908 is seated in a sliding end 1914 of the second pivot lug member 1910. The sliding end 1912 of the first pivot lug member 1908 may be a rounded or contoured protrusion, and may be seated in a rounded or contoured socket of the sliding end 1914 of the second pivot lug 1910. The resulting sliding joint between the first and second pivot lug members may increase the structural rigidity and integrity of the connecting arm assembly 1904. Moreover, the sliding joint may be used to define and/or control how the connecting arm assembly 1904 interacts with the clasp body 1902 and the clasp cover (not shown) when the clasp is closed, and can be used to ensure that the connecting arm assembly 1904 articulates such that the clasp can close completely, and that the connecting arm assembly 1904 does not interfere with the operation (or aesthetics) of the clasp 1900.

Figure 19C:
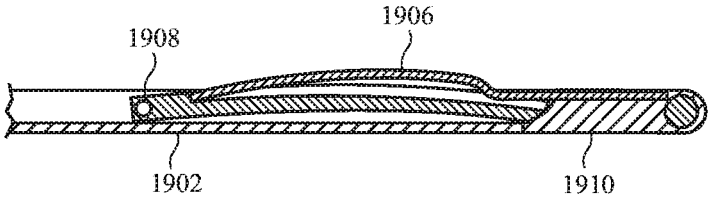

FIG. 19B is an illustrative cross-sectional view of the clasp 1900, including the connecting arm assembly 1904 and the clasp body 1902, taken through line 19B-19B in FIG. 19A, showing the clasp 1900 in an open configuration. FIG. 19C is an illustrative cross-sectional view of the clasp 1900 in a closed configuration, illustrating how the connecting arm assembly 1904 interacts with the clasp body 1902 and articulates when the clasp 1900 is closed. Specifically, as shown in FIG. 19B, the connecting arm assembly 1904 is in an undeformed state (e.g., the compliant member 1906 is in a relaxed state). In this embodiment, the first and second pivot lug members 1908, 1910 are substantially in line with one another, though this need not be the case. (For example, the first and second pivot lug members 1908, 1910 may be disposed at an angle to one another when the connecting arm assembly is undeformed.)

When the clasp is closed, as shown in FIG. 19C, the first pivot lug member 1908 engages with the clasp body (in particular, a bottom surface of a channel in the clasp body 1902) by contacting the clasp body, resulting in deformation of the compliant member 1906 and an articulation of the first pivot lug member 1908 with respect to the second pivot lug member 1910. In particular, the clasp is configured such that the relaxed state of the connecting arm assembly 1904 corresponds to an at least partially open configuration of the clasp. Thus, when the connecting arm assembly 1904 is deformed in order to close the clasp, the force of the connecting arm assembly attempting to return to its relaxed, undeformed state results in a biasing force between the connecting arm assembly 1904 and the clasp body 1902 (e.g., the force of the connecting arm assembly attempting to return to its relaxed state imparts a force between the clasp body 1902 and the connecting arm assembly 1904 that biases the clasp towards an open configuration).

In some embodiments, where the pivot lug members slidably contact one another at a sliding joint, the first pivot lug member 1908 slides and/or pivots around the sliding joint when the first pivot lug member 1908 contacts the clasp body 1902 such that the first pivot lug member 1908 is rotated about the sliding joint. This results in the deformation of the compliant member 1904 that creates a biasing force between the connecting arm assembly 1904 and the clasp body 1902.

Figure 20A:
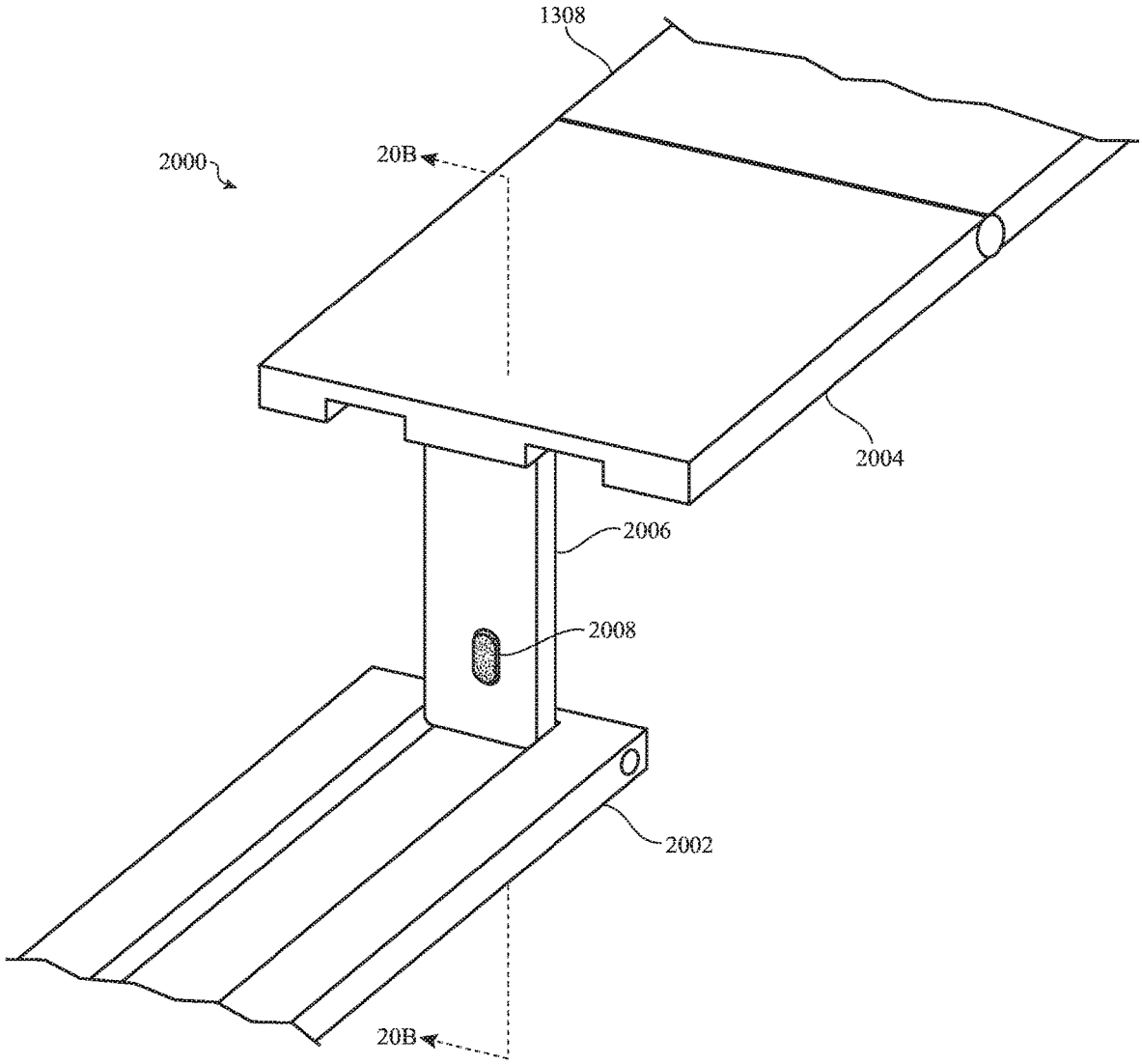
FIG. 20A depicts an illustrative perspective view of a clasp for a wearable electronic device, in accordance with some embodiments.

FIG. 20A is an illustrative perspective view of a clasp 2000, in accordance with some embodiments, showing the clasp 2000 in a partially open configuration. The clasp includes a clasp body 2002, a clasp cover 2004, and a connecting arm 2006 that is pivotally coupled to the clasp body 2002 at a first end of the connecting arm 2006, and pivotally coupled to the clasp cover 2004 at a second end of the connecting arm 2006. The clasp 2000 is movable between an open configuration and a closed configuration, where, in the closed configuration, the clasp body 2002 is retained with the clasp cover 2004, and the connecting arm 2006 is disposed between the clasp body 2002 and the clasp cover 2004.

The clasp 2000 includes an elastomer member 2008 coupled to the connecting arm 2006 (or the clasp body, not shown) such that, when closed, the elastomer member 2008 is disposed at least partially between the connecting arm 2006 and the clasp body 2002. The clasp 2000 also includes an elastomer member 2010 disposed at least partially between the connecting arm 2006 and the clasp cover 2004 (as shown in FIG. 20B).

Figure 20B:
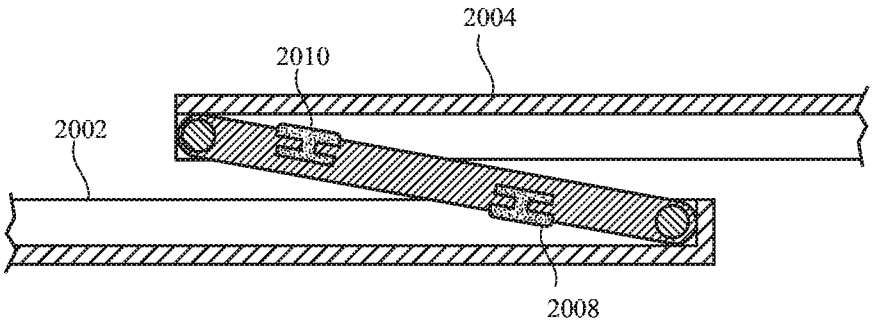
FIGS. 20B-20C depict illustrative cross-sectional views of the clasp of FIG. 20A, in accordance with some embodiments.

FIG. 20B is an illustrative cross-sectional views of the clasp 2000, taken through line 20B-20B in FIG. 20A. FIG. 20B illustrates an embodiment where two elastomer members are used, such that biasing forces are produced between the connecting arm 2006 and both the clasp cover 2004 and the clasp body 2002. In some embodiments, the elastomer members 2008, 2010 are coupled to the connecting arm (as shown), whereas in other embodiments the elastomer members 2008, 2010 are coupled to the clasp body 2002 and the clasp cover 2004, respectively.

The elastomer members 2008, 2010 may be coupled to the connecting arm 2006, the clasp body 2002, or the clasp cover 2004 in any appropriate way. For example, in some embodiments, the elastomer members include retention flanges or recesses, and the elastomer members are configured to be received into an opening in the connecting arm 2006 that has a complementary retention feature. Thus, the elastomer members 2008, 2010 may be retained in the connecting arm 2006. Elastomer members may be made from any suitable elastomer or elastic material, such as polybutadiene, butyl rubber, or any other appropriate elastic material. In some embodiments, the elastomer members are replaced by coil springs, leaf springs, or other spring members of any material.

Figure 20C:
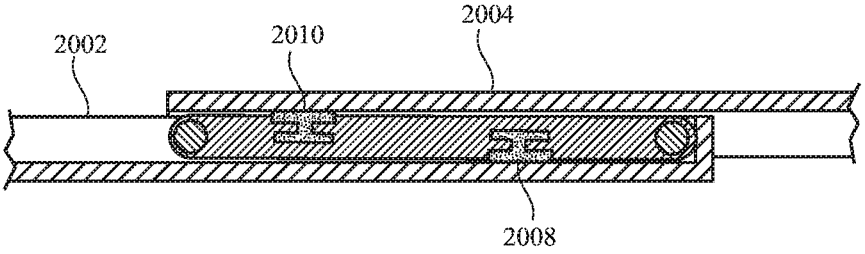

The elastomer members 2008, 2010 are configured to be compressed between the connecting arm 2006 and the clasp body 2002 to impart a biasing force between the connecting arm 2006 and the clasp body 2002. In particular, FIGS. 20B-20C are illustrative cross-sectional views of the connecting arm, taken through line 20B-20B in FIG. 20A. FIG. 20B illustrates the clasp 2000 in an open configuration, where the elastomer members are not being compressed. FIG. 20C illustrates the clasp 2000 in the closed configuration, such that the elastomer member 2008 has been compressed between the clasp body 2002 and the connecting arm 2006, and the elastomer member 2010 has been compressed between the clasp cover 2004 and the connecting arm 2006. Where the clasp includes elastomer members disposed between the connecting arm 2006 and both the clasp cover 2004 and the clasp body 2002 (as shown), the biasing force from the elastomer members forcibly separates both the clasp cover 2004 and the clasp body 2002 when the clasp 2000 is unlatched or otherwise released from a closed configuration.

Figure 21A:
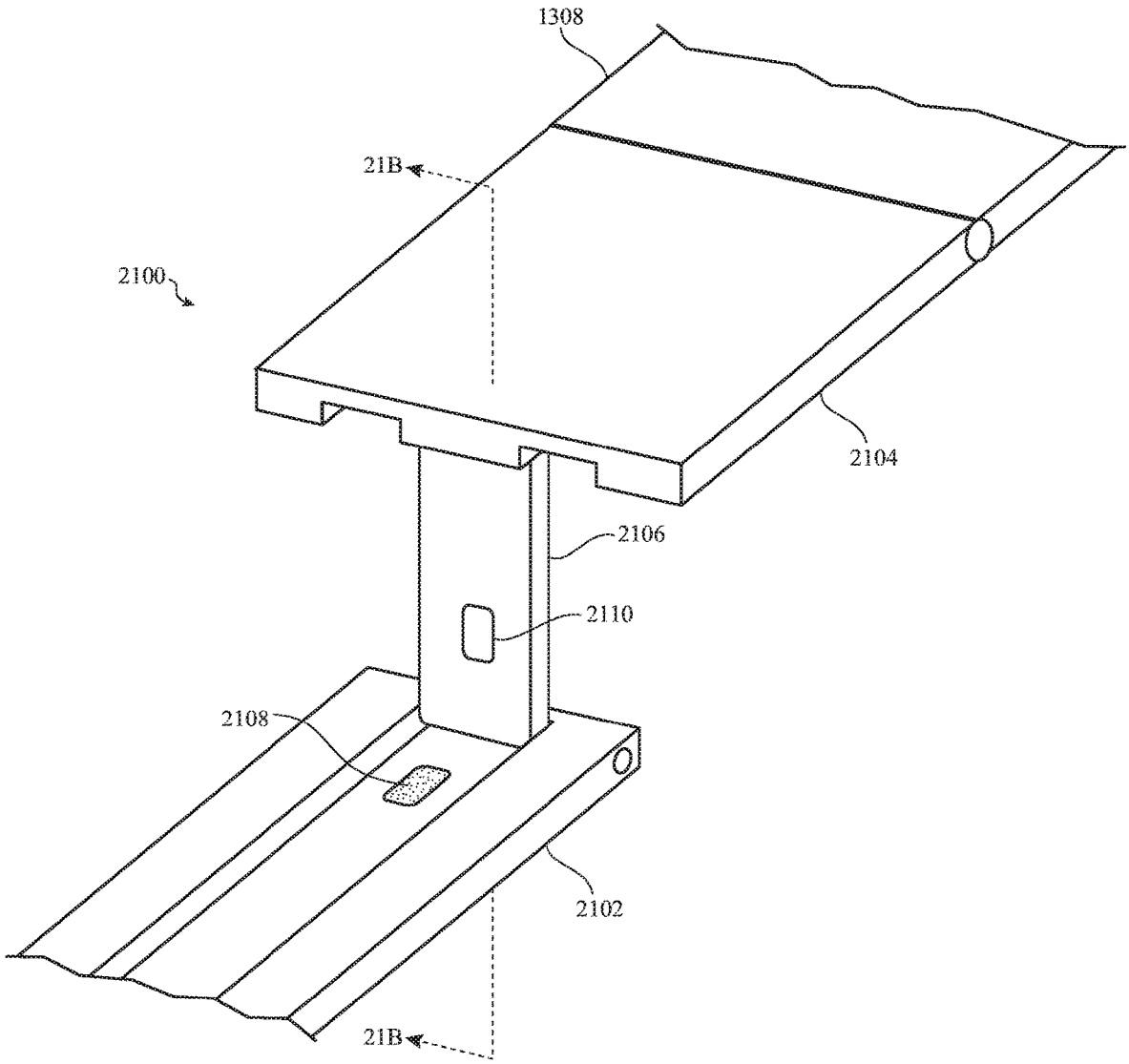
FIG. 21A depicts an illustrative perspective view of a clasp for a wearable electronic device, in accordance with some embodiments.

FIG. 21A is an illustrative perspective view of a clasp 2100, in accordance with some embodiments, showing the clasp 2100 in a partially open configuration. The clasp 2100 is structurally similar to the clasp 2000 described with respect to FIG. 20A, but instead of elastomer members, the clasp 2100 includes magnets that interact with one another to impart a biasing force to the clasp. In particular, the connecting arm 2106 includes a first magnet 2110, and the clasp body 2102 includes a second magnet 2108. The first and second magnets 2110, 2108 are configured such that the magnets repel one another (rather than attract one another) when they are brought into proximity as a result of the clasp 2100 being closed. For example, the north pole of the first magnet 2110 may face outward from the connecting arm 2106, and the north pole of the second magnet 2108 may face outward from the clasp body 2102. Moreover, the first and second magnets are located in positions that ensure their magnetic fields will interact with one another when the clasp is closed. Accordingly, closure of the clasp 2100 results in the north poles of the magnets being brought into proximity, resulting in a magnetic repulsion that imparts a biasing force between the clasp body 2102 and the connecting arm 2106.

In some embodiments, instead of or in addition to the magnets on the clasp body 2102 and connecting arm 2106, a third magnet 2114 is disposed on the connecting arm 2106 facing the clasp cover 2104, and a fourth magnet 2116 is disposed on the clasp cover 2104 (facing the connecting arm 2106) to impart an additional biasing force between the connecting arm 2106 and the clasp cover 2104. The third and fourth magnets 2114 and 2116 are shown in FIGS. 21B-21C.

Figure 21B:
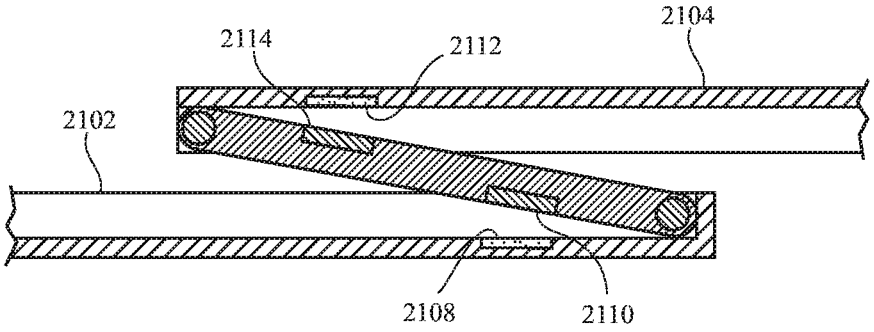
FIGS. 21B-21C depict illustrative cross-sectional views of the clasp of FIG. 21A, in accordance with some embodiments.
Figure 21C:
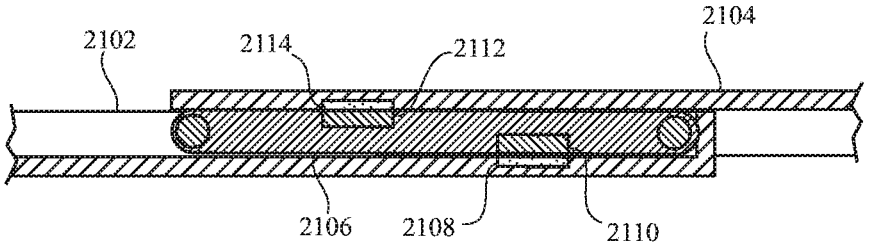

FIGS. 21B-21C are illustrative cross-sectional views of the clasp 2100, taken through line 21B-21B. FIG. 21B illustrates the clasp 2100 in an open configuration, where the magnets have not been brought into close enough proximity to impart an appreciable repulsion force. FIG. 21C, on the other hand, illustrates the clasp 2100 in the closed configuration, such that the magnetic fields of the magnetic pairs (magnets 2110 and 2108, and magnets 2112 and 2114) are each producing a repulsion force. These repulsion forces forcibly separate both the clasp cover 2104 and the clasp body 2102 from the arm 2106.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure as defined in the claims that follow.

What is claimed is:

1. A watch band comprising:
a latching link comprising:
a first body having a first engagement structure;
a latch member moveably disposed at least partially within the first body;
a release button disposed at least partially within the first body and operable to move the latch member relative to the first body; and
a spring; and
a receptacle link configured to be releasably coupled to the latching link, the receptacle link comprising:
a second body having a second engagement structure configured to slidably receive the first engagement structure along a first axis, and to restrict motion of the latching link in a second axis that is perpendicular to the first axis; and
a latch retention structure configured to engage with the latch member to releasably couple the receptacle link to the latching link;
wherein, when the latching link is releasably coupled to the receptacle link, the spring imparts a biasing force via the latch member between the latching link and the receptacle link.

2. The watch band of claim 1, further comprising an additional receptacle link, wherein:
the latching link comprises:
a linking end; and
a fastening end opposite to the linking end; and
the fastening end of the latching link is pivotally coupled to the additional receptacle link.

3. The watch band of claim 1, further comprising an additional latching link, wherein:
the additional latching link comprises:
a linking end; and
a fastening end opposite to the linking end; and
the fastening end of the additional latching link is pivotally coupled to the receptacle link.

4. The watch band of claim 1, wherein the latch member is pivotally coupled to the second body by a pivot member oriented along a pivot axis.

5. The watch band of claim 4, wherein the pivot axis is parallel to the first axis.

6. The watch band of claim 4, the first body further comprising a first surface and a second surface opposite to the first surface, wherein:
the release button is exposed through an aperture in the first surface; and
the latch member includes an engagement portion extending beyond the second surface.

7. The watch band of claim 6, wherein actuation of the release button when the latching link is engaged with the receptacle link causes the latch member to be rotated about the pivot axis, thereby disengaging the latch member from the latch retention structure of the receptacle link.

8. The watch band of claim 6, wherein the engagement portion of the latch member is configured to engage with the latch retention structure of the receptacle link in order to releasably couple the latching link to the receptacle link.

9. The watch band of claim 1, wherein:
the first engagement structure includes a slide;
the second engagement structure includes a channel configured to receive the slide.

10. A watch band comprising:
a latching link comprising:
a first body having a first engagement structure;
a latch member pivotably coupled to the first body; and
a release button configured to, when pressed, push against the latch member to cause the latch member to pivot, the latch member being biased against the release button; and
a receptacle link configured to be releasably coupled to the latching link, the receptacle link comprising:
a second body having a second engagement structure configured to allow the first engagement structure to slide along a first axis and to restrict motion of the latching link in a second axis that is perpendicular to the first axis; and
a latch retention structure configured to engage with the latch member when the first engagement structure slides to a predetermined position along the first axis, wherein, when the latch retention structure is engaged with the latch member, the latch retention structure restricts motion of the latching link in the first axis.

11. The watch band of claim 10, wherein the receptacle link further comprises a biasing spring assembly configured to impart a biasing force between the latching link and the receptacle link while the latching link is releasably coupled to the receptacle link.

12. The watch band of claim 11, wherein the release button is operable to overcome the biasing force.

13. A watch band comprising:
a latching link comprising:
a first body having a first engagement structure;
a latch member disposed at least partially within the first body; and
a release button disposed at least partially within the first body and operatively coupled to the latch member; and
a receptacle link configured to be releasably coupled to the latching link, the receptacle link comprising:
a second body having a second engagement structure configured to slidably receive the first engagement structure along a first axis, and to restrict motion of the latching link in a second axis that is perpendicular to the first axis; and
a latch retention structure configured to engage with the latch member to releasably couple the receptacle link to the latching link;
a biasing spring assembly coupled to the latching link or the receptacle link and disposed between the latching link and the receptacle link such that the biasing spring assembly imparts a biasing force between the latching link and the receptacle link when the latching link is releasably coupled to the receptacle link, the biasing spring assembly comprising:

a plunger slidably coupled to the first body; and a spring disposed between the plunger and the first body, wherein engagement of the plunger with the receptacle link causes the plunger to be translated in a first direction, and the spring imparts the biasing force in a second direction opposite to the first direction.

14. The watch band of claim 13, further comprising an additional receptacle link, wherein:

the latching link comprises:

a linking end; and a fastening end opposite to the linking end; and the fastening end of the latching link is pivotally coupled to the additional receptacle link.

15. The watch band of claim 13, further comprising an additional latching link, wherein:

the additional latching link comprises:

a linking end; and a fastening end opposite to the linking end; and the fastening end of the additional latching link is pivotally coupled to the receptacle link.

16. The watch band of claim 13, wherein the latch member is pivotally coupled to the second body by a pivot member oriented along a pivot axis.

* * * * *